US010636249B1

(12) United States Patent
Jordan

(10) Patent No.: US 10,636,249 B1
(45) **Date of Patent: *Apr. 28, 2020**

(54) GAMING MACHINE WITH REMOTE REDEMPTION OPTIONS

(71) Applicant: Michael Todd Jordan, Burlington, NC (US)

(72) Inventor: Michael Todd Jordan, Burlington, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/043,838

(22) Filed: Jul. 24, 2018

Related U.S. Application Data

(63) Continuation of application No. 15/005,586, filed on Jan. 25, 2016, now Pat. No. 10,043,343.

(60) Provisional application No. 62/256,327, filed on Nov. 17, 2015, provisional application No. 62/106,781, filed on Jan. 23, 2015.

(51) Int. Cl.
*G07F 17/32* (2006.01)

(52) U.S. Cl.
CPC ..... *G07F 17/3244* (2013.01)

(58) Field of Classification Search
USPC ..... 463/25
See application file for complete search history.

(56) References Cited

U.S. PATENT DOCUMENTS 8,047,902 B2 11/2011 Kane et al. ..... 463/16
8,357,034 B2 * 1/2013 Smith ..... G07F 17/32 463/25
8,496,525 B2 7/2013 Mosley et al. ..... 463/27
8,523,657 B2 9/2013 Michaelson et al. ..... 463/20
8,537,392 B2 9/2013 d'Entrecasteaux ..... 359/1.15
8,545,315 B2 10/2013 Mosley et al. ..... 463/25
8,545,317 B2 10/2013 Mosley et al. ..... 463/25
8,550,901 B2 * 10/2013 Walker ..... G07F 17/3227 463/25
8,585,493 B2 11/2013 Mosley et al. ..... 463/26
8,784,180 B2 7/2014 Stanek ..... 463/17
8,805,947 B1 8/2014 Kuzkin et al. ..... 709/208
9,152,366 B2 10/2015 Gutnik et al. ..... G06F 3/1296
10,043,343 B1 8/2018 Jordan
2004/0039847 A1 2/2004 Persson et al. ..... 709/250
2008/0009336 A1 * 1/2008 Walker ..... G07F 17/32 463/16
2009/0124384 A1 * 5/2009 Smith ..... G07F 17/32 463/42
2010/0088360 A1 4/2010 Jaudon et al. ..... 709/203
(Continued)

*Primary Examiner* — Pierre E Elisca
(74) *Attorney, Agent, or Firm* — MacCord Mason PLLC

(57) ABSTRACT

An gaming apparatus, systems and methods with a remote redemption option including a payment acceptance device for accepting payment from a player; at least one display screen that displays symbols, a player's balance and game status information; at least one electronic game module for storing gaming information, operating a game and/or determining a redemption amount to a player; a control electronics in communication with the at least one electronic game module for processing the redemption amount to the player; and a payout dispenser for dispensing a redemption voucher to the player. The disclosure also includes an exchange center having an exchange point of sale within a store having at least one gaming device, wherein the exchange center accepts the redemption voucher as payment for an item of value.

8 Claims, 23 Drawing Sheets

(56) References Cited

U.S. PATENT DOCUMENTS

| | | | | |
|---|---|---|---|---|
| 2011/0034231 | A1 | 2/2011 | Breslo et al. | 463/20 |
| 2013/0138490 | A1 | 3/2013 | Mosley et al. | 705/14.14 |
| 2013/0331178 | A1 | 12/2013 | Mosley et al. | 463/26 |
| 2013/0344948 | A1 | 12/2013 | Mosley et al. | 463/25 |
| 2014/0135112 | A1 | 5/2014 | Mosley et al. | 463/26 |
| 2015/0018069 | A1* | 1/2015 | Montenegro | G07F 17/326<br>463/20 |
| 2015/0045112 | A1* | 2/2015 | Donavan | G07F 17/3244<br>463/25 |
| 2017/0032610 | A1* | 2/2017 | Loz | G07F 17/3213 |

* cited by examiner

370

| Summary | |
|---|---|
| Account ID: | 88 |
| Currenrt Sell Price per Troy Ounce (ozt) | $13.19 |
| Insured | 0.00 ozt |
| Insured Value | $0.00 |
| Current Uninsured | 0.00 ozt. |
| Uninsured nValue | $0.00 |
| Maximum Single Transaction is $2,500.00 | |

| Redeemable | |
|---|---|
| Current Balance | $0.00 |
| Available Quantity | 0.00 ozt |
| Total Pending Transactions | 0 |
| Sale Holdings | |
| Total Pending Safe Holdings Transactions | 0 |
| Total Amount in Safe Holdings | $0.00 |
| For each Payment requested there is $0.50 processing fee. | |

371

Pending Transactions

| Sell | Purchase Date | Purchase Location | POS Number | Credit/Cash | Insurance | netSilver | Current netSilver Value | Days Left |
|---|---|---|---|---|---|---|---|---|

| Selected: | netSilver: | Amount: | Processing: | Payment Type: | |
|---|---|---|---|---|---|
| 0 | 0 ozt | $0.00 | $0.00 | $0.00 | Select Payment Type ▾ Submit |

373

Safe Holdings

| Holdings Date | Purchase Location | POS Number | Debit Amount | Item Price | Sold netSilver | Sold Value | Days In |
|---|---|---|---|---|---|---|---|

| Selected: | Amount: | Processing: | Payment Type: | |
|---|---|---|---|---|
| 0 | $0.00 | $0.00 | $0.00 | Select Payment Type ▾ Submit |

Transactions History

| Date Sold | Type of Payment | Echeck Number | Debit Amount | Items per Check | Item | Purchase Price | Purchase Date |
|---|---|---|---|---|---|---|---|

FIG. 8B

380

Traders, Inc.
123 Street
Atlanta, GA 12345
(000) 000-0000

--RECEIPT--

08/21/2015 Inv. #328

| | | |
|---|---|---|
| | Credit | $150.00 |
| 9.07oz | Silver Purchased | $146.25 |
| | Silver Exchange Fee: | $3.75 |
| | Subtotal: | $0.00 |
| | Taxes: | $0.00 |
| | Total: | $0.00 |
| | Total Due: | $0.00 |
| | Amount Tendered: | $0.00 |

Thank You For Being a Trader

FIG. 8C

390

| Summary | |
|---|---|
| Account ID: | 88 |
| Currenrt Sell Price per Troy Ounce (ozt) | $13.19 |
| Insured Silver | 0.00 ozt |
| Insured Silver Value | $0.00 |
| Current Uninsured Silver: | 0.00 ozt. |
| Uninsured Silver Value | $0.00 |
| Maximum Single Transaction is $2,500.00 | |

| Redeemable Silver | |
|---|---|
| Current Balance | $0.00 |
| Available Quantity of Silver | 0.00 ozt |
| Total Pending Transactions | 0 |
| **Sale Holdings** | |
| Total Pending Safe Holdings Transactions | 0 |
| Total Amount in Safe Holdings | $0.00 |
| For each Payment requested there is $0.50 processing fee. | |

Pending Transactions

| Sell | Purchase Date | Purchase Location | POS Number | Credit/Cash | Insurance | netSilver | Current netSilver Value | Days Left |
|---|---|---|---|---|---|---|---|---|
| Selected: | Silver: | Amount: | Processing: | Request Check | The operation was successful. Here is your check: | | | |
| 0 | 0 ozt | $0.00 | $0.00 | $0.00 | | | Request Check | Submit |

Safe Holdings

| Holdings Date | Purchase Location | POS Number | Debit Amount | Item Price | Sold Silver | Sold Value | Days In |
|---|---|---|---|---|---|---|---|
| Selected: | Amount: | Processing: | Payment Type: | | | | |
| 0 | $0.00 | $0.00 | $0.00 | | | Select Payment Type | Submit |

Transactions History

| Date Sold | Type of Payment | Echeck Number | Debit Amount | Items per Check | Silver | Purchase Price | Purchase Date |
|---|---|---|---|---|---|---|---|
| 08/21/2015 | E-check | 126 | 146.25 | 1 of 1 Item | 9.07 ozt | $119.63 | 08/21/2015 |

FIG. 8E

400

| Summary | |
|---|---|
| Account ID: | 88 |
| Currenrt Sell Price per Troy Ounce (ozt) | $13.19 |
| Insured Silver | 0.00 ozt |
| Insured Silver Value | $0.00 |
| Current Uninsured Silver: | 0.00 ozt. |
| Uninsured Silver Value | $0.00 |
| Maximum Single Transaction is $2,500.00 | |

| Redeemable Silver | |
|---|---|
| Current Balance | $243.75 |
| Available Quantity of netSilver | 15.12 ozt |
| Total Pending Transactions | 1 |
| Sale Holdings | |
| Total Pending Safe Holdings Transactions | 0 |
| Total Amount in Safe Holdings | $0.00 |
| For each Payment requested there is $0.50 processing fee. | |

Pending Transactions

| Sell | Purchase Date | Purchase Location | POS Number | Credit/Cash | Insurance | netSilver | Current Silver Value | Days Left |
|---|---|---|---|---|---|---|---|---|
| | 08/21/2015 | | | Credit | $0.00 | 15.12ozt | $243.75 | 29 |

| Selected: | netSilver: | Amount: | Processing: | Request Check | The operation was successful. Here is your check: |
|---|---|---|---|---|---|
| 0 | 0 ozt | $0.00 | $0.00 | $0.00 | Request Check / Submit |

391

Safe Holdings

| Holdings Date | Purchase Location | POS Number | Debit Amount | Item Price | Sold Silver | Sold Value | Days In |
|---|---|---|---|---|---|---|---|

| Selected: | Amount: | Processing: | Payment Type: | |
|---|---|---|---|---|
| 0 | $0.00 | $0.00 | $0.00 | Select Payment Type / Submit |

Transactions History

| Date Sold | Type of Payment | Echeck Number | Debit Amount | Items per Check | Silver | Purchase Price | Purchase Date |
|---|---|---|---|---|---|---|---|
| 08/21/2015 | E-check | 126 | 146.25 | 1 of 1 Item | 9.07 ozt | $119.63 | 08/21/2015 |

FIG. 8 F

420

Bullion Requested ×

| Total | Silver Value | Price per ozt |
|---|---|---|
| 12.12ozt | $243.75 | $16.12 |

| Shipping address: |
|---|
| George Katie |
| 124 OK strett |
| Big Surf, ok 65831 |

| Choose your delivery option: | |
|---|---|
| •FedEx Next day Shipping | $19.40 |
| •FedEx 2 day Shipping | $12.50 |
| •UPS Next day Shipping | $18.28 |
| •UPS 2 day Shipping | $13.02 |
| •UPS Ground Shipping | $10.50 |

| Place your Order | |
|---|---|
| Order Summary | |
| Item Value: | $243.75 |
| Shipping & Handling (S/H) | $19.40 |
| net Value after S/H: | $208.65 |
| Estimated tax to be collected: | $15.70 |
| Totals: | $224.35 |
| Total adj. Silver | 12.94ozt |

| Shipping Bullion ozt: | 12 ozt |
|---|---|
| Bullion Value | $193.44 |

| Transferred to Safe Holdings: | 0.94 ozt |
|---|---|
| | $15.21 |

PLACE YOUR ORDER | CANCEL

FIG. 8G

440

| Summary | |
|---|---|
| Account ID: | 88 |
| Currenrt Sell Price per Troy Ounce (ozt) | $13.19 |
| Insured Silver | 0.00 ozt |
| Insured Silver Value | $0.00 |
| Current Uninsured Silver: | 15.12 ozt. |
| Uninsured Silver Value | $243.75 |
| Maximum Single Transaction is $2,500.00 | |

| Redeemable Silver | |
|---|---|
| Current Balance | $243.75 |
| Available Quantity of Silver | 15.12 ozt |
| Total Pending Transactions | 1 |
| Sale Holdings | |
| Total Pending Safe Holdings Transactions | 0 |
| Total Amount in Safe Holdings | $0.00 |
| For each Payment requested there is $0.50 processing fee. | |

Pending Transactions

| Sell | Purchase Date | Purchase Location | POS Number | Credit/Cash | Insurance | Silver | Current Silver Value | Days Left |
|---|---|---|---|---|---|---|---|---|

| Selected: | Silver: | Amount: | Processing: | Payment Type | The request is sent for processing | |
|---|---|---|---|---|---|---|
| 1 | 15.12 ozt | $243.75 | $0.00 | $0.00 | Request Bullion | Submit |

Safe Holdings

| Holdings Date | Purchase Location | POS Number | Debit Amount | Item Price | Sold Silver | Sold Value | Days In |
|---|---|---|---|---|---|---|---|
| 08/21/2015 | 7/11 | 1 | $15.21 | $15.21 | 0.94ozt | $15.21 | 0 |

| Selected: | Amount: | Processing: | Payment Type: | | |
|---|---|---|---|---|---|
| 0 | $0.00 | $0.00 | $0.00 | Select Payment Type | Submit |

Transactions History

| Date Sold | Type of Payment | Echeck Number | Debit Amount | Items per Check | Silver | Purchase Price | Purchase Date |
|---|---|---|---|---|---|---|---|
| 08/21/2015 | Bullion | 127 | 194.44 | 1 of 1 Item | 12 ozt | $158.28 | 08/21/2015 |
| 08/21/2015 | E-check | 126 | 146.25 | 1 of 1 Item | 9.07 ozt | $119.63 | 08/21/2015 |

FIG. 8H

GAMING MACHINE WITH REMOTE REDEMPTION OPTIONS

FIELD

The present disclosure relates generally to a gaming machine, and more particularly, to a gaming machine with remote redemption options.

BACKGROUND

Many types of gaming machines are known in the art. Changing regulations often alter and control the types of gaming systems allowed in a particular geographic location. These regulations may be due to the types of game being played and/or the types of payouts being allowed and/or distributed.

Sweepstakes type games, often utilizing online and electronic gaming systems, have evolved to be played using a computer gaming system that may be coupled to a communication network, for example an intranet or The Internet. Among these developing games are, for example, games of skill, games of chance, amusement type games, and more casino-type games. As games evolve along with the regulations, a more streamlined and simplified gaming machine having a gaming system with improved redemption options are desired by Applicant. This is true, for example, in sweepstakes games where redemption options may often be limited to pull-tab cards and the like and/or redemption for physical items sold or housed within the gaming facility.

The field of gaming, especially a gaming machine allowing redemption options to the user, has become complicated, often limited, and difficult to navigate with changing and geographically diverse regulations depending often on gaming classifications. Applicant desires a more versatile gaming system, for example, with improved, flexible redemption options. These flexible redemption options, in some examples, being allowable in multiple jurisdictions, simplifying redemption for users and/or allowing for instant redemption for remote items. Such a gaming machine would likely appeal to a broader gaming audience.

SUMMARY

In accordance with the present disclosure, in one example, a gaming machine includes a payment acceptance device for accepting payment from a player; at least one display screen that displays symbols, a player's balance and game status information; at least one game module adapted for storing gaming information, operating a game and determining a payout to a player; a control electronics in communication with the at least one game module for processing the payout to the player; a payout dispenser for offering a redeemable value payout to the player; and an exchange center in communication with the gaming machine, wherein the exchange center accepts a player's redeemable payout value, determines an exchange rate for the redeemable value, and exchanges the redeemable value for it for another item of value.

In another embodiment an electronic gaming system includes a gaming machine. The gaming machine includes a payment acceptance device, at least one display, and a payout dispenser. In this aspect, the gaming system also includes at least one electronic game module, a control electronics and an exchange center.

The payment acceptance device is adapted to accept payment from a player. A player's payment may be in any form, for example, cash, coins, tokens, pull-tabs, certificates and/or scannable codes.

The gaming machine may have one or more display screens. The at least one display screen may display symbols, a player's balance and/or game status information.

The screen may be a touch screen and/or by way of example, may have buttons configured to correspond to screen items.

The payout dispenser is configured to dispense a payout to the player. The payout, for example, may be in the form of cash (unless otherwise specified herein), coins, tokens, pull-tabs, certificates, vouchers, any item indicting a redeemable value and/or scannable codes.

The electronic game module typically stores gaming information, operates a game and determines a payout to a player. The game module may be located in the gaming machine, at the gaming facility and/or may be remote from the gaming machine and/or gaming facility. The electronic game module may be in communication with a network that allows communication with a server that controls the gaming at the gaming facility and/or machine. The network may allow an intranet or Internet connection.

The control logic electronics is in communication with the at least one electronic game module for controlling the gaming machine processes, such as, processing the payout to the player and processing the payment from the player.

The exchange center accepts a player's redeemable payout value and exchanges it for another form of tender and/or an item of value, for example, by way of a purchase of the item of value with the redeemable value. Tender as used herein may be cash, any form of currency, a voucher, a token, a valued amount held in a member account, etc. The exchange center may be considered to be at the gaming facility and/or remotely located from the electronic gaming machine and/or facility. The exchange center may be an entity unrelated to the gaming facility, such as a $3^{rd}$ party exchange entity.

The gaming system may include an exchange module that is in communication with the electronic game module. The exchange module is also in communication with the exchange center. The exchange module may be in communication with the exchange center via a network connection, such as an Internet connection. The payout may, in some examples, be calculated from the player's balance and the player notified on the display what the payout would be. The exchange module may offer the player the option of exchanging the payout through the gaming machine connection to the exchange center. The exchange may be made before the payout is made to the player. The exchange may be a post-payout offer made at the machine after payout is made to the player. The exchange may be instant. Any items of value purchased by the player with a redeemable value may be instantly available to the player, may not be instantly available to the player, may be shipped to the player, may be exchanged instantly by the player, may be exchanged after a time period by the player, may have a frozen value established at the time of the redemption and/or any other time.

The disclosure also includes a gaming system with online redemption options. The system may offer a player redemption options when a player accumulates a positive balance. The redemption options may include, by way of example, redeeming the positive balance in cash, redeeming the positive balance in certificates, and/or redeeming the positive balance through an online exchange center.

Certificates, vouchers, tokens and/or any representation of the redeemable value may be dispensed to the player from the machine. The certificates may represent incremental amounts and values. The certificates may be taken to an exchange center or an exchange center access point, such as an exchange point of sale device, for redemption within the gaming facility and exchanged for redeemable value. Redeemed as used herein may indicate in some examples an exchange and/or a sale. A certificate may have a monetary value and/or may be valued for an amount of an article. The article may be a commodity. The certificates may be exchanged for the value amount of the commodity. The gaming facility may have an amount of the commodity on-hand at the gaming facility for completing player redemption exchanges. In many instances, a gaming facility is a store offering products for purchase that also includes gaming machines. A gaming facility may be a facility set up to offer sweepstakes type of games and/or amusement types of games.

The player may redeem a positive online balance through the online exchange center that will exchange the positive balance amount through an online transaction through the gaming system. The exchange center may accept any form of positive balance. For example, the player's positive balance may be valued in forms other than cash, such as, in diamonds, emeralds, gold, and silver, etc. The player's positive balance may be valued in a commodity. The player may be offered redemption of the commodity online through an exchange center that exchanges the valued amount of the player's commodity for another form of reimbursement. The reimbursement may, for example, be monetary and/or certificates that are able to be exchanged for money.

In some embodiments, an electronic gaming system may include a gaming machine with remote redemption options. The gaming machine may include a payment acceptance device for accepting payment from a player; at least one display screen that displays symbols, a player's balance and game status information; at least one game module adapted for storing gaming information, operating a game and determining a payout to a player; a control electronics in communication with the at least one game module for processing the payout to the player; and a payout dispenser for offering a redeemable value payout to the player in a non-cash form. The gaming system may also include a point of sale exchange device located apart from the gaming machine that is configured to receive a player's redeemable value payout in a non-cash form and to communication with a remotely located exchange center to offer the player an item of value in exchange for the player's redeemable value payout that is in a non-cash form. The exchange center may be configured to: accept a player's redeemable payout value in a non-cash form, determine an exchange rate value for the redeemable value, offer an item of value in exchange for the player's redeemable payout value, calculate an appropriate amount of the item of value equal to the redeemable value, and process a sale of the redeemable value in exchange for the appropriate amount of the item of value.

The inventions disclosed may also be considered a method of conducting an electronic game including an exchange option. The game may be, by way of example, a game of chance and/or a game of skill. The exchange option may be a remote exchange option.

In one example, a method of conducting an electronic game includes: providing an electronic gaming machine; accepting payment from a player; displaying game information to the player; processing game information; awarding a player a credit amount for a winning result during a game; allowing the player to cashout a positive balance; and providing a redemption option to the player such that a value of the player's balance may be exchanged for another form of currency for the player's payout amount.

The inventions of the present disclosure are applicable to most any type of game, for example, games of skill, games of chance, amusement type games, sweepstakes games, online games, computer games, casino-type games, fantasy sports games, and/or any games using tickets, vouchers and/or tokens for payment.

In one example, items of value may include any product that on a repetitive basis is being purchased and sold back, that is available in the store, in a magazine, or in the cloud or on the internet for purchase with currency.

These and other aspects of the inventions of the present disclosure will become apparent to those skilled in the art after a reading of the following description of the preferred embodiment when considered with the drawings.

The above summary was intended to summarize certain embodiments of the present disclosure. Embodiments will be set forth in more detail in the figures and description of examples below. It will be apparent, however, that the description of examples is not intended to limit the present inventions, the scope of which should be properly determined by the appended claims.

BRIEF DESCRIPTION OF THE DRAWINGS

Embodiments of the disclosure will be better understood by a reading of the Description of Examples along with a review of the drawings, in which:

FIG. 8A-8H are examples of portions of one embodiment of an exchange center within an exchange system as disclosed.

DETAILED DESCRIPTION OF EXAMPLE EMBODIMENTS

Figure 1A:
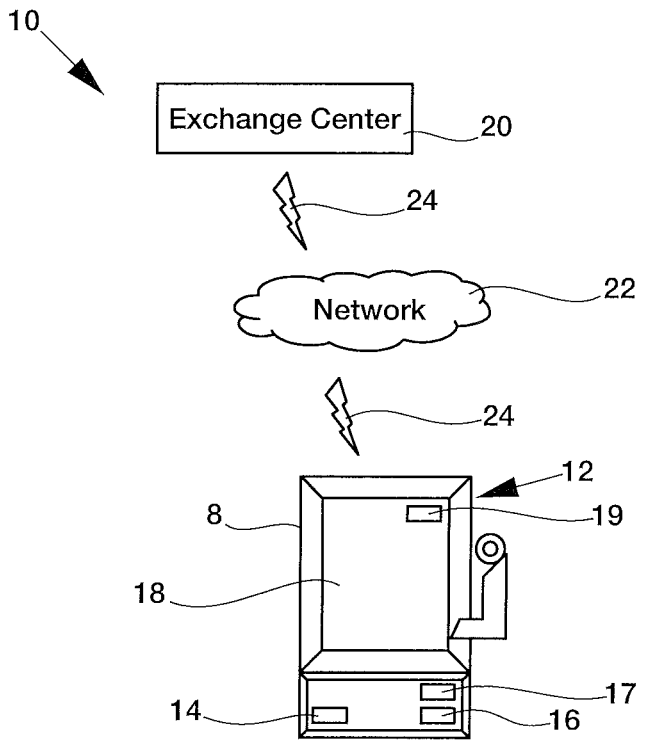
FIG. 1A is a diagram of one example of a gaming machine associated with a gaming system according to the present disclosure.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Variable types of gaming machines and systems are known in the art. One type of gaming machine includes a slot machine. To play a slot machine, a player deposits currency (for example, as money, coins, tokens, and/or redemption certificates) in a payment reservoir in the machine. Once the payment is accepted, the player accrues a balance as an appropriate number of credits for wagering on the machine. For example, a dollar may be deposited into the payment reservoir by the player, to establish a positive player balance. Once the dollar is accepted, the player will have a one dollar positive balance, equaling a dollar's worth of credits that can be used for wagering. The player determines the amount of the credit that he/she would like to wager, typically based upon minimum requirements per wager, such that a twenty-five cent wager may, for example be a minimum allowed wager, making 4 credits available from the one dollar deposit. The player often may choose to wager one or more of the 4 credits available in this example on one "play" or, here, spin of the slot reel. The player chooses the wager and then spins the reel, usually by pressing a button, touching the screen or pulling a handle. After the reel stops spinning, symbols are displayed in configurations on the machine, for example in a symbol window on the machine or on a screen. Pre-determined winning combinations, according to a pay-table, pays out credits to a player when a winning combination of symbols results. Credits won may be added cumulatively to the player's overall balance. The player may choose to continue to play or to collect the remaining balance by "cashing-out," for example, in a cashout/payout amount equal to the redeemable balance. In some examples, where cash and forms of currency payouts are not allowed, other payouts may be available.

An example of one type of electronic gaming system allows a player to begin a game at a gaming machine, similar to a slot machine, and to receive "pull-tab" game tickets from the gaming machine. Pull-tabs conventionally are known as game tickets bearing a number of symbols, covered by a removable tab/coating that is able to be removed or scratched off. Some of the cards bear winning symbols or combinations of symbols may be presented to redeem prizes. Alternatively, pull-tabs may be distributed from a gaming device as a part of or as the player's balance cash-out.

Typically, such gaming devices, that distribute pull-tabs, outwardly resemble gaming machines of the type known as "slot machines," "slots," or "one-aimed bandits." In using these pull-tab pay-out devices, a player proceeds similarly as described above, by entering a payment into the machine, payment is processed into credits and then the player "plays" either by pulling a lever, in the case of an electromechanical machine, or pressing a button or touching the screen, in the case of a fully electronic machine. The machine presents the player with a matrix of moving symbols, which become static in a final display. The static matrix may contain a winning combination of symbols. A credit is issued to the player's balance and pay-out may occur through an amount of pay-tab cards of equal value to the player's in-machine balance. Both cash and pull-tab payout machines are popular, however, in some jurisdictions; machines of the cash payout-type are illegal, although pull-tab games are not. Therefore, there has been a movement toward pull-tab type machines, in sweepstakes and other gaming scenarios.

Even pull-tab games are not legal in all jurisdictions, however, in jurisdictions where pull-tab gaming machines are not permitted, certain games of chance may be allowed if the player receives an item of value for the amount that may otherwise be considered a wager. Thus, a pull-tab gaming ticket may be provided to a patron in conjunction with an item that is purchased, even if the patron's true motivation for making the purchase is to receive the gaming ticket.

Other examples of gaming machines may be associate with gaming systems that are often classified as being games of skill. Games of skill are typically differentiated because they allow for player input and, thus, the opportunity to improve a player's odds of winning over the default odds in a game of chance. Whether a game is a game of skill or a game of chance is a classification being used by some government regulatory authorities in determining whether a game may be allowed in certain venues. More detail regarding the operation of games of skill is found, for example, in US Patent Application Publication No. 2011/0034231 to Breslo et al., the entirety of the publication being herein incorporated by reference. With the types of games allowed varying between states and regulatory authority, Applicant recognized a need for a simplified redemption system associated with a gaming machine and a gaming system that provides alternative redemption options. In some examples, a redemption and exchange system that would allow standardized redemptions across municipalities with varying regulations was not currently available before Applicant's invention.

Gaming systems as referenced herein may include but not be limited to, for example, games of skill, games of chance, amusement games, social games, sweepstakes games, skill sweepstakes games, redemption games, computer games, and/or online games. Applicant's gaming machine may be associated with any of these gaming systems, alone or in combination. The gaming system may be locally located on a gaming machine, may be an electronic gaming system, and/or, by way of example, may be remotely operated to run over a network connect, for example intranet or Internet, locally at the gaming facility.

Figure 1B:
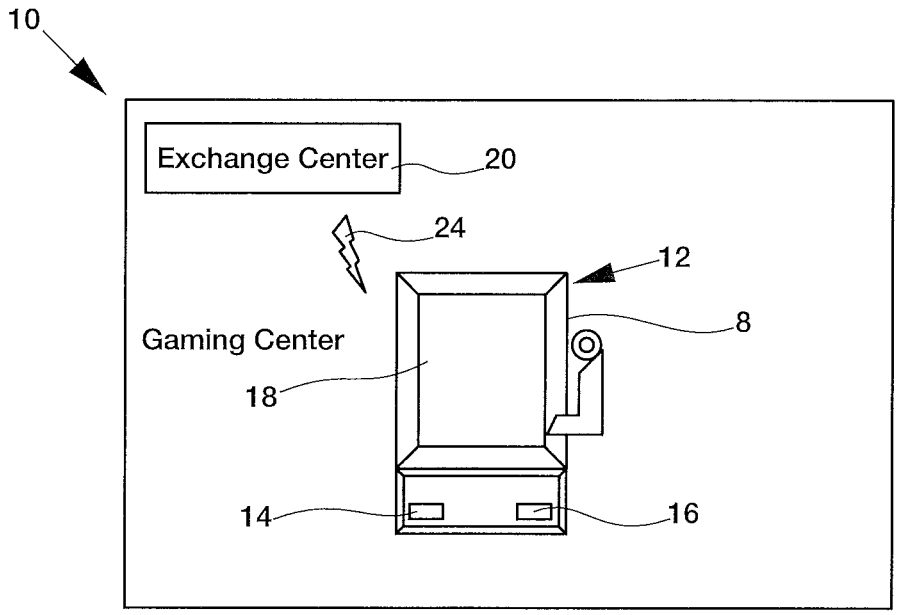
FIG. 1B is a diagram of one example of a gaming machine associated with a gaming system according to the present disclosure.
Figure 2:
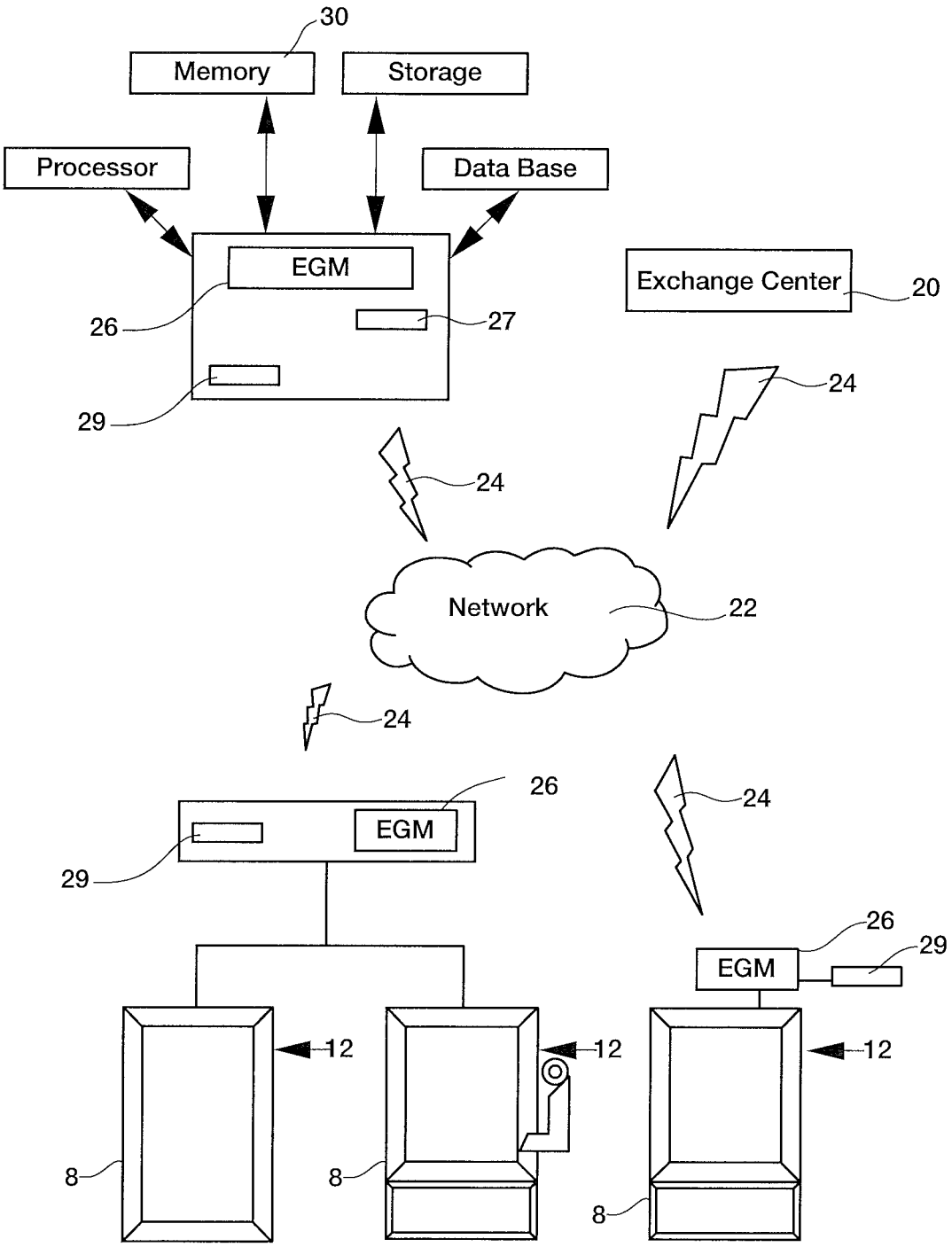
FIG. 2 is a diagram of one example of a gaming machine of FIG. 1 associated with an electronic gaming system according to the present disclosure.

As shown in the drawings for purposes of illustration, the present disclosure includes a gaming machine 12 associated with or a part of a gaming system 10. More specifically, FIGS. 1 through 2 show a gaming system 10 including a gaming machine 12. The machine 12 includes a casing 8, preferably in some examples, of steel, plastic or similar material, a display screen 18 for displaying reel-type information, analogous to the way electromechanical slot machines display rotatable reels on which symbols or indicia are imprinted. The display screen 18 is typically also used to display player credits and/or other information. The machine 12 also includes a payment acceptance device 14, in some examples a cash box, a set of play mechanism and/or buttons 19 and a payout dispenser 16.

Also, included with the machine 12 may be a ticket dispenser 17, and optionally, included may be a winner light (not shown), which alerts players and others that a winning game has been played.

The system 10 may include a game module 26. The game module 26 may be configured to operate a game and include a control electronics logic 29 for program operation control of the machine in a relatively straight forward manner, as will be further described below.

The logic controls the video display 18 and the payment acceptance device 14, as well as the payout dispenser 16 operation.

The gaming machine 12 may also include a ticket scanner and may also dispense tickets from the payout device.

They system also typically includes a memory module 30, which in turn is in communication with the game module 26.

The memory module 30 contains a record of data for each game played in the machine. The memory module 30 in one example may be a flash memory that is both programmable and stable, for example, the contents of the memory are preserved even when electrical power is not supplied to the module. The module is preferably highly tamper-proof, such that any attempt to read, copy or modify the contents of the module renders it inoperative for purposes of the gaming machine.

The gaming module 26 is able to determine whether the game results is a winning combination of symbols. This win-lose result may be also stored in the memory module 30, or the gaming module 26 may determine from internally stored game rules whether the combination of symbols is a winning one or not. In the case of a winning game, the game logic 29 may activate a winner indicator and/or a winner light on the machine to alert the player that a winning combination has resulted. The winner indicator and/or light may be on the display screen 18 or located elsewhere on the machine 12.

The game module 26 may be associated directly with a particular gaming machine 12, with a group of gaming machines within or outside the gaming facility, and/or may reside remotely and be in contact with the gaming machine or machines through a network 22, for example, an intranet or the Internet 24.

Figure 3:
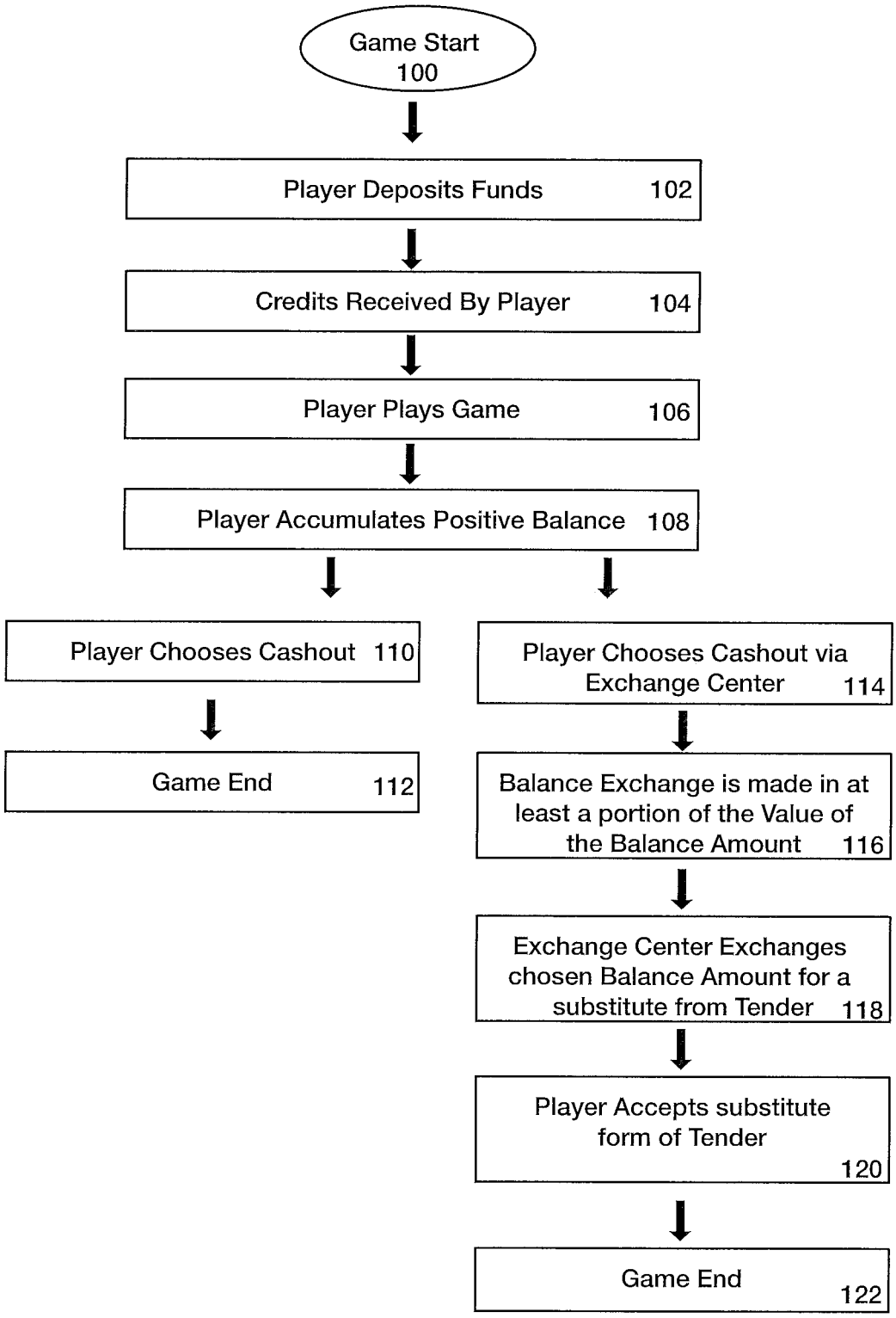
FIG. 3 is a flow chart of one example of a gaming machine with redemption options according to the present disclosure.

FIG. 3 shows various functions performed by the control logic 29, by way of example, that include, at a game start 100, when the gaming machine is waiting to be activated, checking for deposit of a coin, currency and/or payment into the machine 102. Once a payment has been made, and credit is established, or remains from a prior play of the machine 104, the logic checks repeatedly for actuation of a "play" button on the machine. Once a play has been initiated by the player 106, the logic initiates a game sequence, such as spinning the reel and/or indicia on the video screen 18. The memory module 30, possibly depending on whether the game is a game of skill or of chance, may allow player input during the game. An electronic game module 26 determines whether the play has resulted in any winning combinations. If a winning combination is indicated, a credit is awarded to the player's balance 108. The player may elect to cashout (receive a redemption) 110 and/or play again using the player credits, or additional funds, prior to game end 112.

From an accumulated balance 108, a player may choose to cash out via an exchange center 114 and a balance exchange made for at least a portion of the value of the balance amount 116. An exchange center may exchange a chosen balance amount for a substitute tender 118 and the substitute tender is accepted by the player 120, prior to game end 122.

Figure 4:
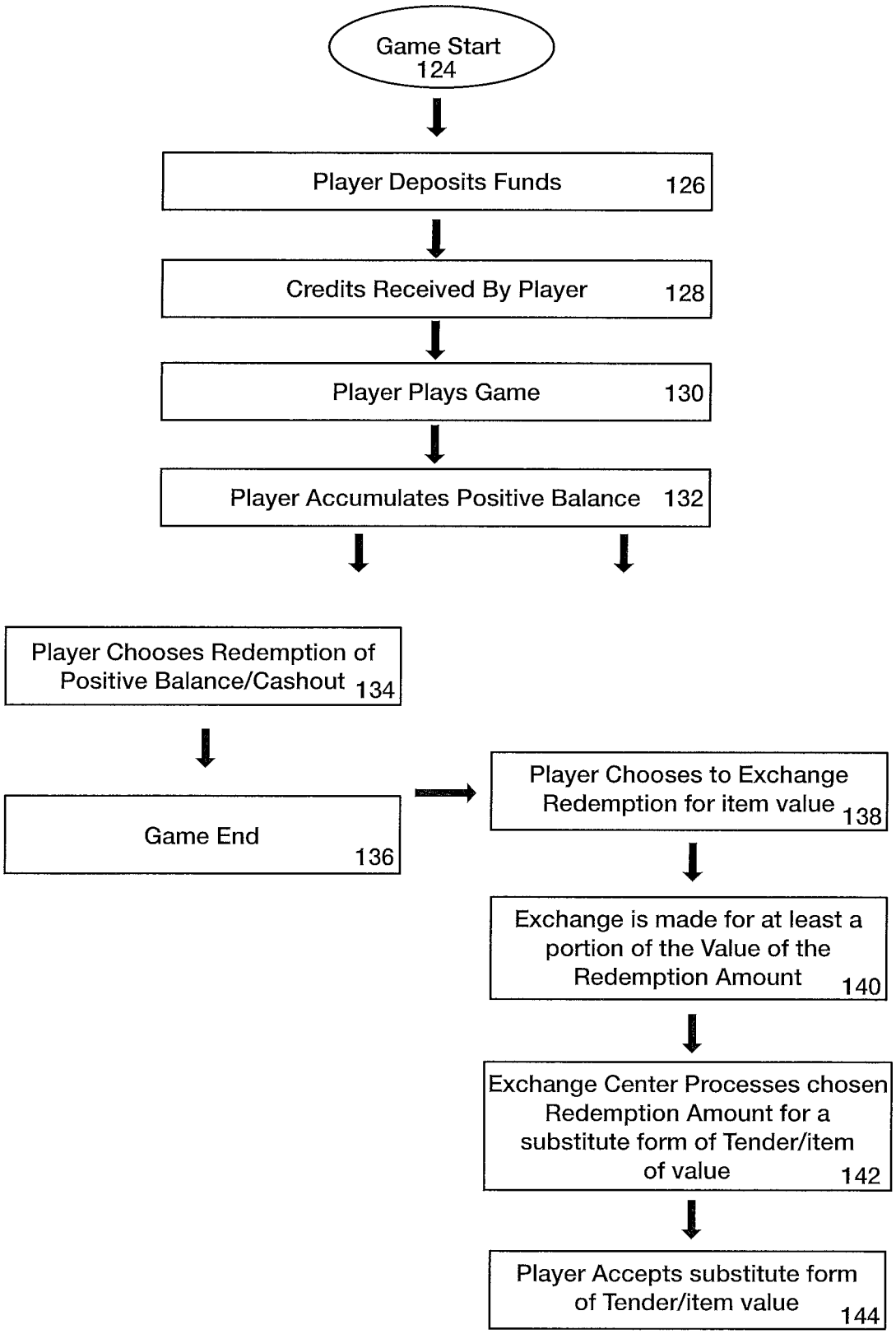
FIG. 4 is a flow chart of another example of a gaming machine with redemption options according to the present disclosure.
Figure 5A:
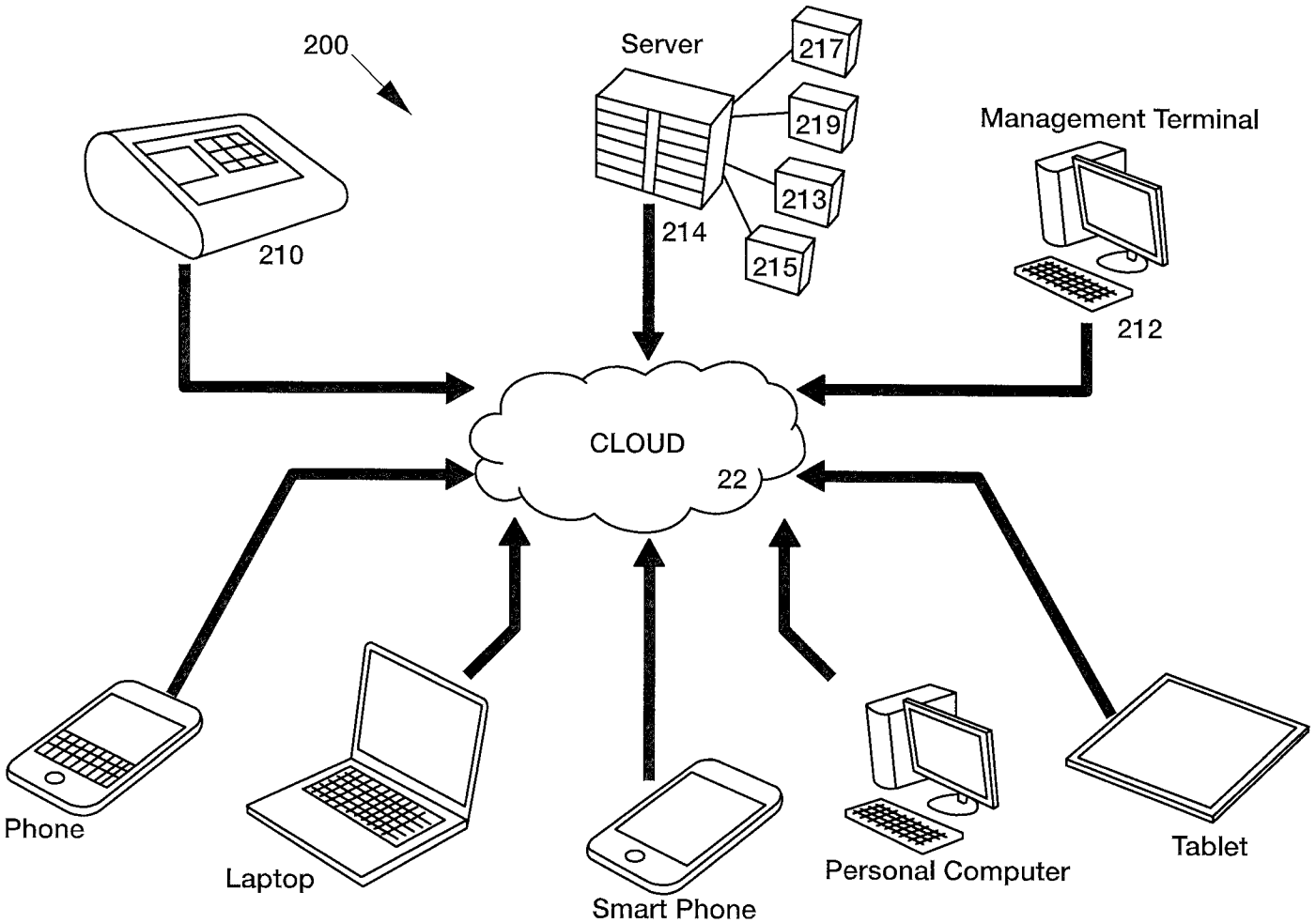
FIG. 5A-5F show exemplary embodiments of portions of an exchange system.
Figure 5B:
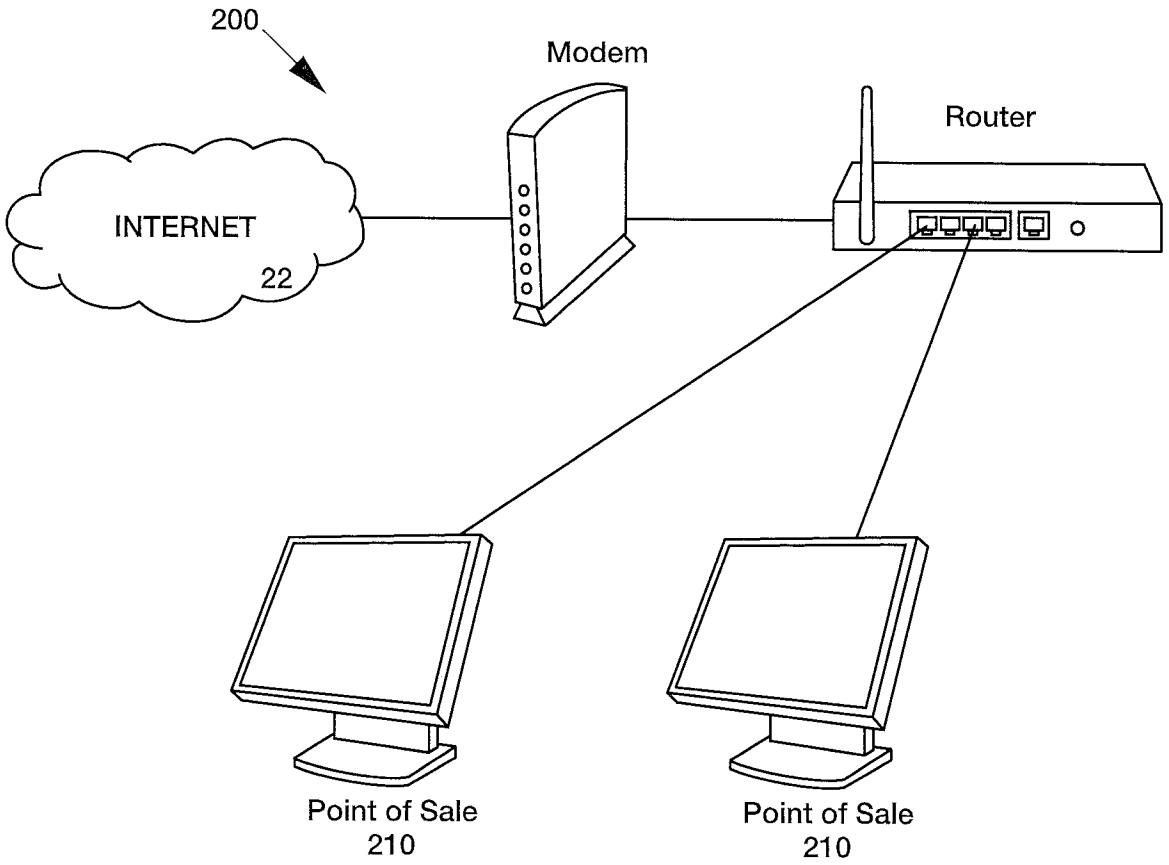
Figure 5C:
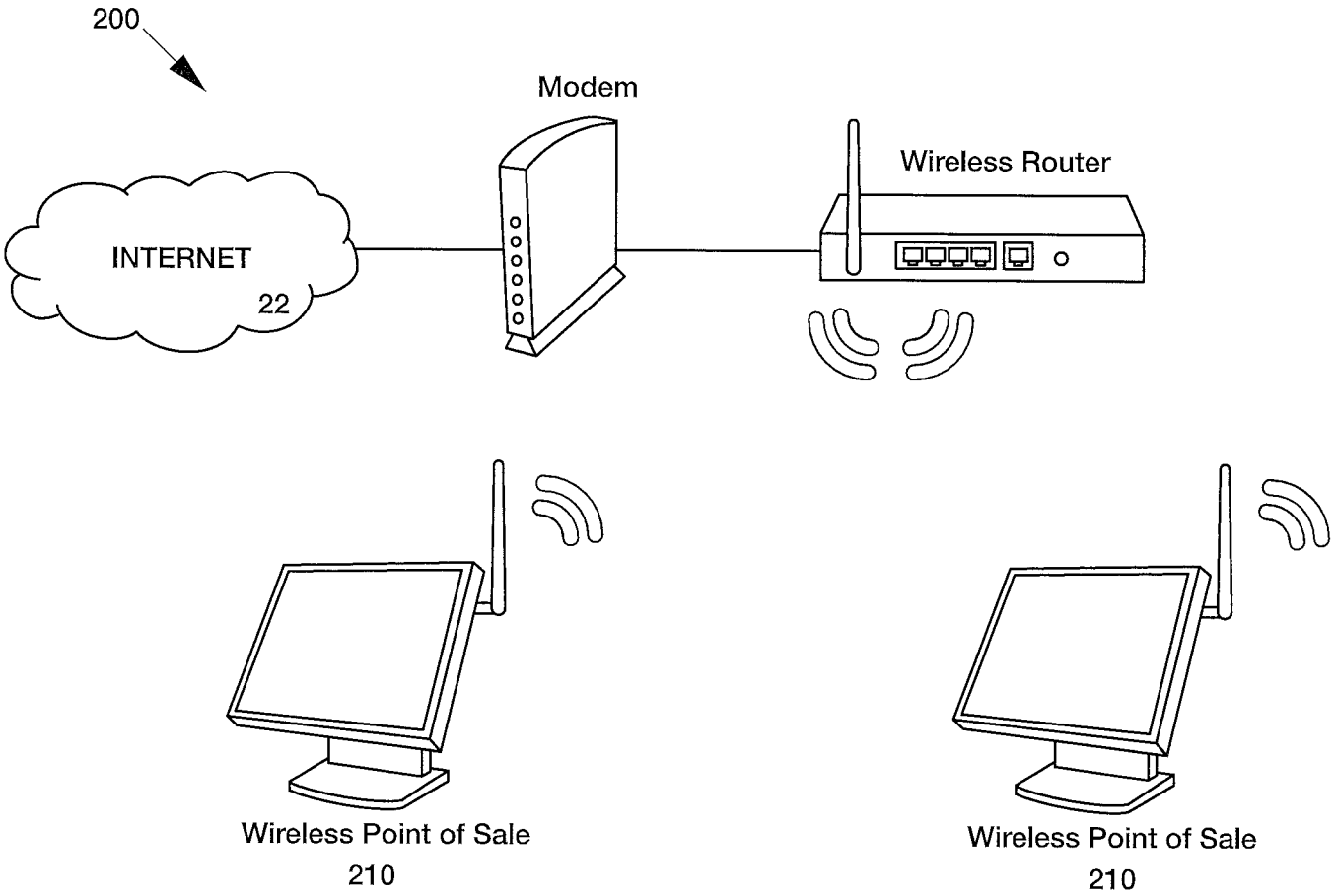
Figure 5D:
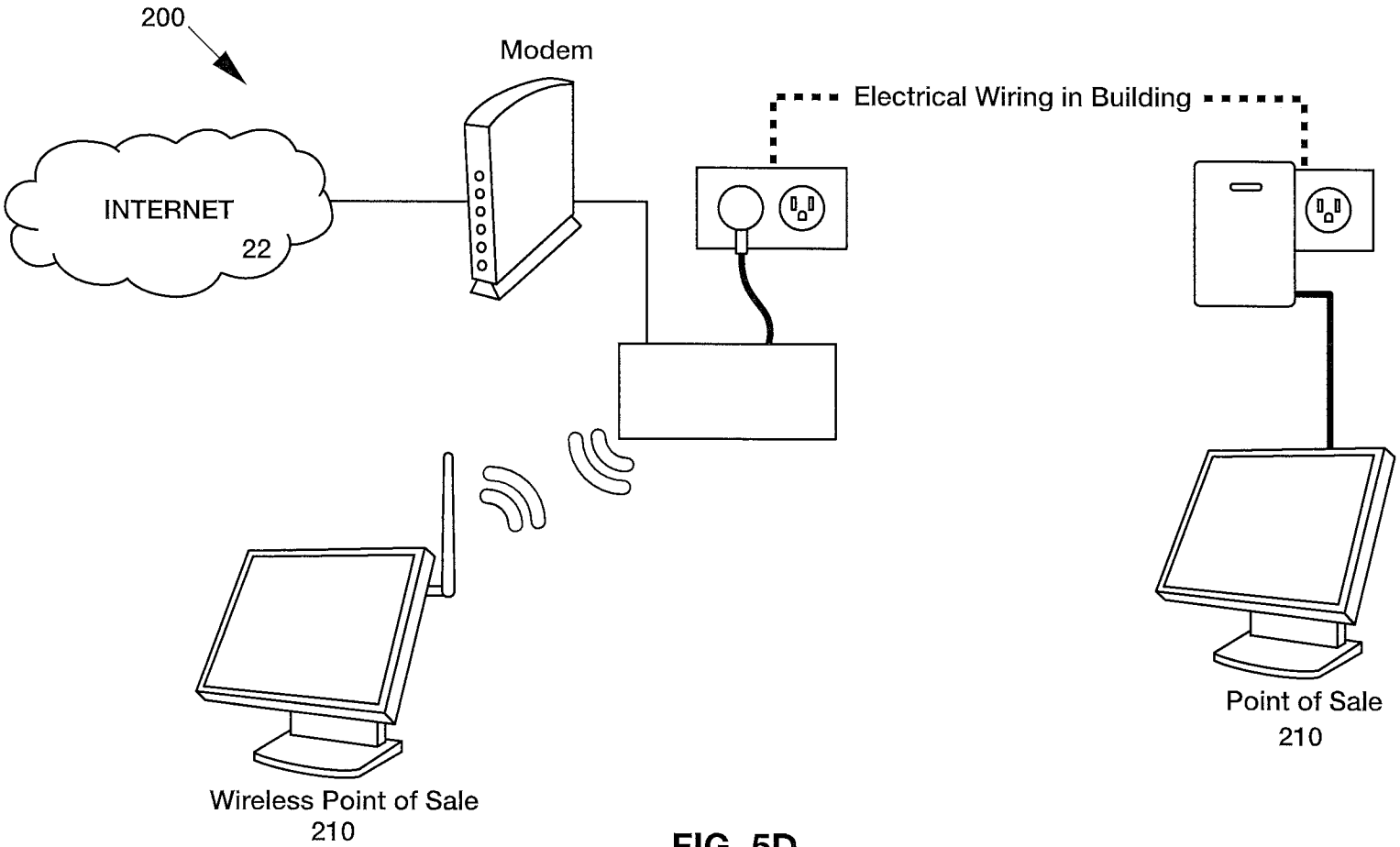
Figure 5E:
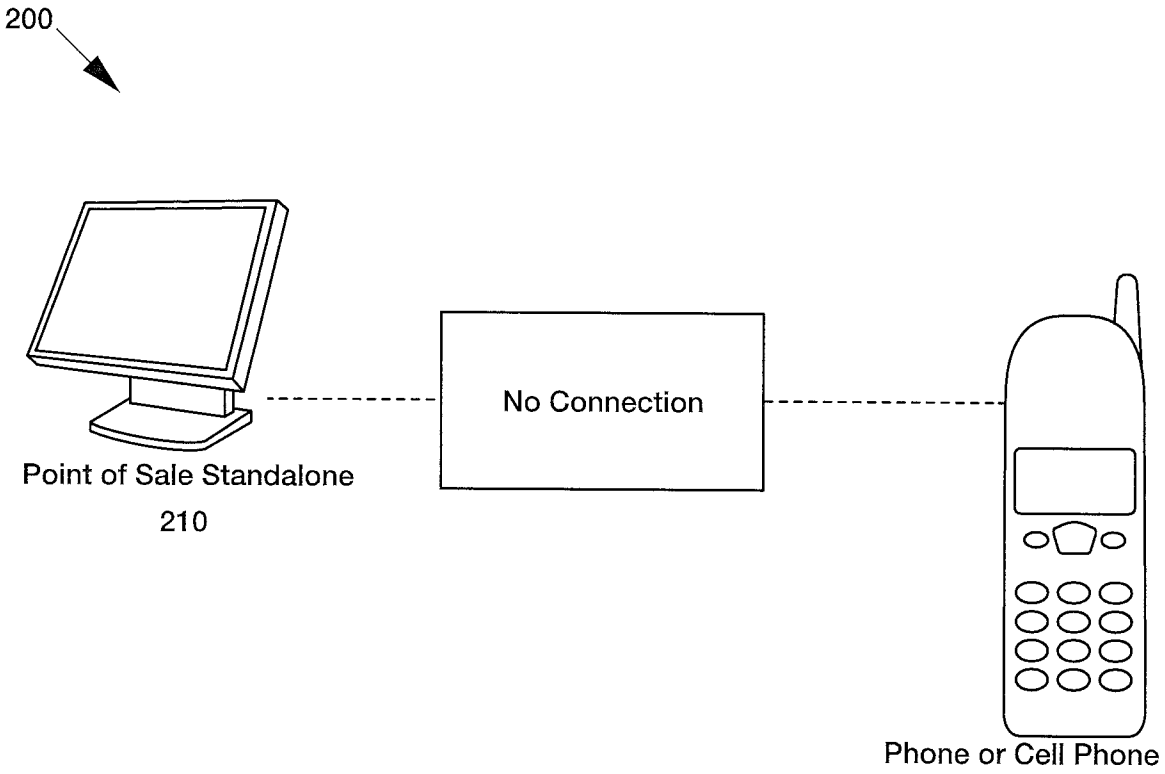
Figure 5F:
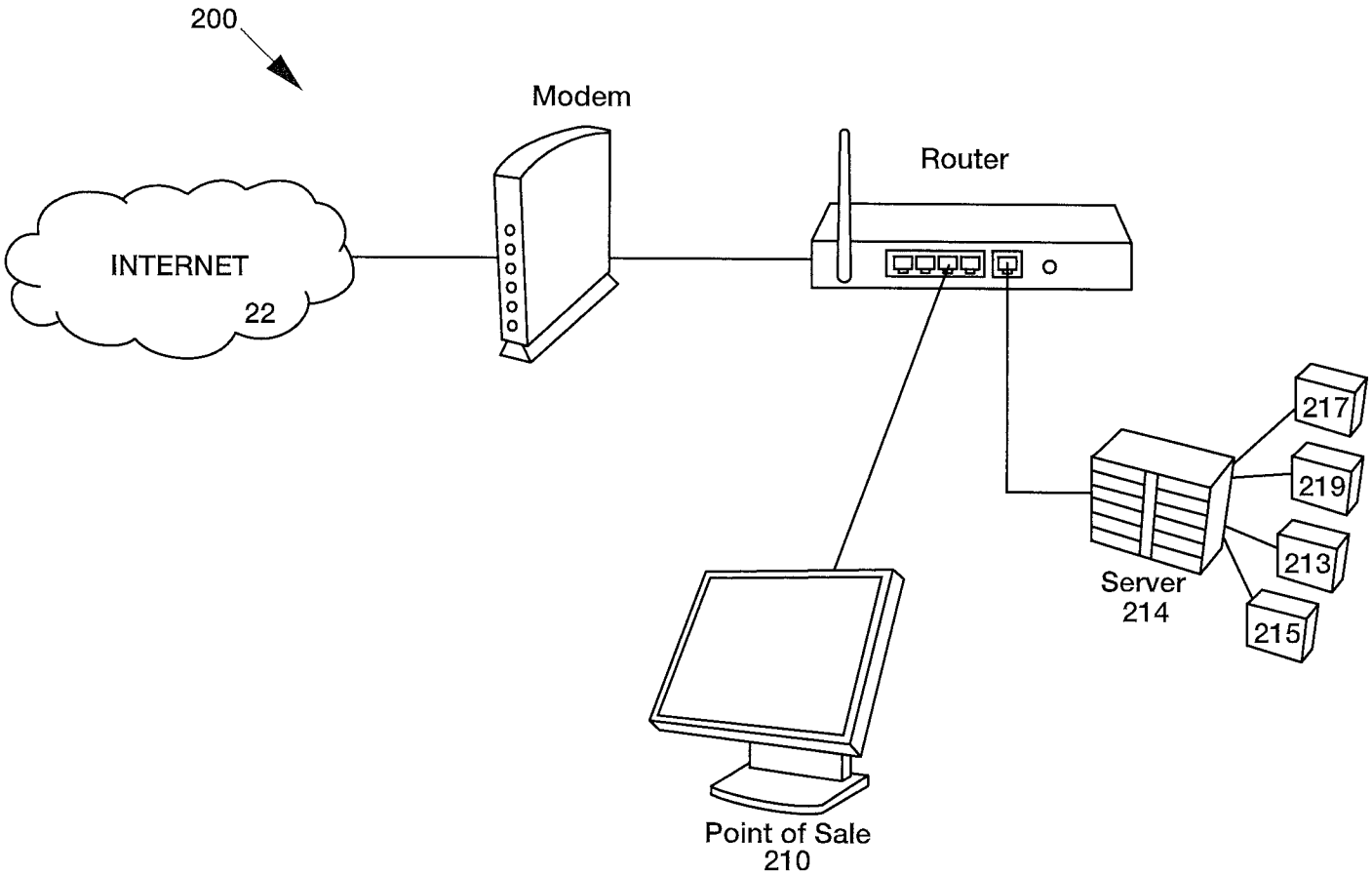

Still in other examples, as shown in FIG. 4, to start a game 124, a player may deposit funds 126, receive credits 128, play game 130, accumulate a positive balance 132 and choose to cash out 134 and end game 136 or choose an exchange redemption for item value 138. When an exchange redemption for item value 138 is chosen, exchange may be made for at least a portion of the value of the redemption amount 140, the exchange center processes the chosen redemption amount for a substitute form of tender 141 and the player accepts or rejects the substitute form of tender 144.

In some embodiments, the gaming machine 12 may accept forms of payment other than monetary payment to establish credits in the machine. The gaming machine may include a receiver for a voucher or ticket as the payment acceptance device 14. The game module will trigger the game control logic 29, in this example, to read the ticket and/or encoded ticket identifier and obtains the related stored information. The information is then processed to display the related information, such as in the form of a recognized form of credits.

In some examples, various payout options may be available on the system. In jurisdictions that permit pull-tab gaming machines, the payout may be in the form of tokens, such as pull-tab tickets. However, where pull-tab gaming is not allowed, an invention of the present disclosure may be embodied in a machine that dispenses articles/items of value. In this case, the tickets would have intrinsic value apart from the game of chance. For example, the tickets may comprise prepaid telephone calling cards. Thus, a customer purchasing such a card would receive value for the purchase in the form of prepaid telephone service. The game of chance is incidental to the utility of the calling card, even though it may provide significant motivation for the purchase. In other embodiments, the payout tokens may take any form, such as a redemption token of a particular value, and/or may be representations or actual items of value, such as but not limited to, silver bars, coins or silver tokens and/or other representations of value, such as for example, gold pieces, gemstone pieces, gas vouchers, food vouchers, any products having intrinsic value, etc.

Still in other examples, the player may, in Applicant's invention, be presented with the option of an exchange through the gaming machine of an item of value for the player's redemption amount available from the game. By way of example, once a game has been completed, a player is able to see the value of their redeemable balance. The electronic game module 26 may trigger the logic 29 to activate an exchange module 27, which in turn, provides the player with access to an exchange center 20. The exchange module 27 being in communication with the electronic game module 26, has access to the player's balance and the logic 29 values the players balance in terms of a token. In one example, the token may be an article of value, such as silver coins. The player is offered the opportunity to sell/trade/redeem its payout amount in exchange for another form of redemption through the gaming machine. An online communication may be established with a 3$^{rd}$ party entity. The third part entity may be associated with and/or may be an exchange center 20. The entity may be associated with the gaming establishment or independent of the gaming establishment. An online communication may be established to allow for communication to the entity. By way of example, a silver exchange may serve as the entity and in an exchange center 20 may purchase a player's token value and in exchange reimburse the player within the gaming machine 12, within the gaming system 10 and/or outside the gaming machine 12 or gaming system 10 for those tokens. They system may payout the reimbursement to the player in a variety of forms. The player may receive a ticket and/or voucher for the exchange as a reimbursement and may redeem the ticket value at another machine 12, a machine 12 at another location, within the gaming facility, for example, at a facility checkout counter, and/or at another location remote from the gaming facility.

In some examples, the gaming system 10 is an electronic gaming system as shown, for example, in FIG. 2 and includes a gaming machine 12 including a payment acceptance device 14, at least one display 18, and a payout dispenser 16. In this embodiment, the gaming machine also includes at least one electronic game module 26, a control electronics logic 29 and an exchange center 20.

The payment acceptance device 14 is adapted to accept payment from a player. A player's payment may be in any form, for example, cash, coins, tokens, pull-tabs, certificates and/or scannable codes.

The gaming machine may have one or more display screens 18. The at least one display screen may display symbols, a player's balance and/or game status information. The screen may be a touch screen and/or by way of example, may have buttons configured to correspond to screen items.

The payout dispenser 16 is configured to dispense a payout to the player. The payout, for example, may be in the faun of cash, coins, products, tokens, pull-tabs, vouchers, certificates, commodities and/or scannable codes.

The electronic game module 26 typically stores gaming information, operates a game and determines a payout to a player. The game module may be located in the gaming machine or may be remote from the gaming machine. The electronic game module 26 may be in communication with a network that allows communication with a server that controls and/or supports the gaming at the gaming machine. The network may allow an intranet or Internet connection.

The control electronics logic 29 is in communication with the at least one electronic game module 26 for controlling the gaming machine processes, such as, processing the payout to the player and processing the payment from the player.

The exchange center 20 accepts a player's payout and exchanges it for another form of tender by way of redemption. The exchange center 20 may be remotely located from the electronic gaming machine 12 and/or system 10. The exchange center 20 may be an entity unrelated to the gaming facility, such as a $3^{rd}$ party entity.

The gaming system 10 may include an exchange module 27 that is in communication with the electronic game module 26. The exchange module 27 is also in communication with the exchange center 20. The exchange module 27 may be in communication with the exchange center via a network connection 22, such as an Internet connection. The payout may, in some examples, be calculated from the player's redeemable balance with the player notified, on the display for example, what that payout would be. The exchange module 27 offers the player the option of exchanging the payout through the gaming machine connection to the exchange center 20. The exchange may be made before the payout is made to the player. The exchange may be a post-payout offer made at the machine after payout is made to the player. The exchange may be instant.

In one example, a player's payout may be calculated by the gaming system in the form of a product, for example, commodities, such as, silver coins and/or gold coins. In this example, the player is offered the amount of silver coins as a payout/redemption option and, alternatively, provided the option to exchange the coins for another form of tender, such as cash, items of value and/or credit, at an exchange center (that exchanges, for example, silver coins for cash) in communication with the gaming system 10. The player forfeits his/her silver coins (value of silver coins) in exchange for a cash payout redemption made at the gaming machine. Such redemption may be made by way of certificates of incremental values that are redeemed at the redemption center within the gaming facility. The exchange center 20 may be provided its silver tokens (such as bars, bullion, and/or coins)/reimbursement by the gaming center operator/facility, and likewise a silver company may pay/reimburse the exchange center 20 on a selected schedule.

The payout offered by the gaming system 10 may be in any form, for example, may be in one or more tokens (considered collectively any form or payout other than cash), such as, pull-tab cards, other farms of commodities, for example coins. The tokens may be considered, for example, the one or more silver coins, silver pieces and/or silver bars.

In this example, the electronic gaming machine 12 exchange center 20 allows the player to sell the one or more silver coins in exchange for a monetary reimbursement of the value of the silver.

The electronic gaming machine may be in communication with more than one exchange center 20. The exchange center 20 may be an online currency exchange. The online currency exchange may be a silver exchange entity.

The electronic gaming machine may offer the player to play a game of chance.

The electronic gaming machine may offer the player to play a game of skill.

The electronic gaming machine may offer the player any form of payout wherein the payout includes an intrinsic value. In some examples, preprinted tickets may have an intrinsic value. In this example, the preprinted tickets may be exchanged for an amount of reimbursement in another form.

In some examples an exchange system 200 may be partially housed within a gaming facility and/or not housed within the gaming facility. The exchange system may be associated with a gaming system 10, and may include at least one gaming machine 12, that may operate as previously described. The exchange system may operate independently of the gaming system 10. The exchange system 200 may be incorporated into the gaming system structure and/or may be associated with the gaming system structure but may also operate independently of it to offer items of value for sale. An exchange system 200 may be configured to recognize a redeemable value from a gaming device 12. The exchange system 200 may be configured to accept a redeemable value to purchase an item of value, for example, silver bullion. The exchange system 200 may include an exchange point of sale device 210 in a gaming facility. The exchange point of sale device 210 may be incorporated into a point of sale register and/or computer of the gaming facility and/or the exchange point of sale device 210 may be a stand-alone device providing a point of sale of items of value as a redemption of a redeemable value accumulated from a gaming device. An exchange system 200 may include an exchange module 213.

FIGS. 5A-5E show examples of an overview of an exchange system 200. The exchange system 200 may include an exchange point of sale 210. The point of sale 210 may be accessible to players that have received a cashout/redemption value from a gaming system of a redeemable value. Typically, the redeemable value balance will be collected by the player from the gaming system 10 as a representation of their redeemable balance value, such as for example, a barcode on a ticket, a voucher and/or a token. When a player wishes to participate in the exchange system 200, in one example, the player first becomes an exchange member. There may be, in some cases, a member fee for becoming an exchange member.

Figure 8A:
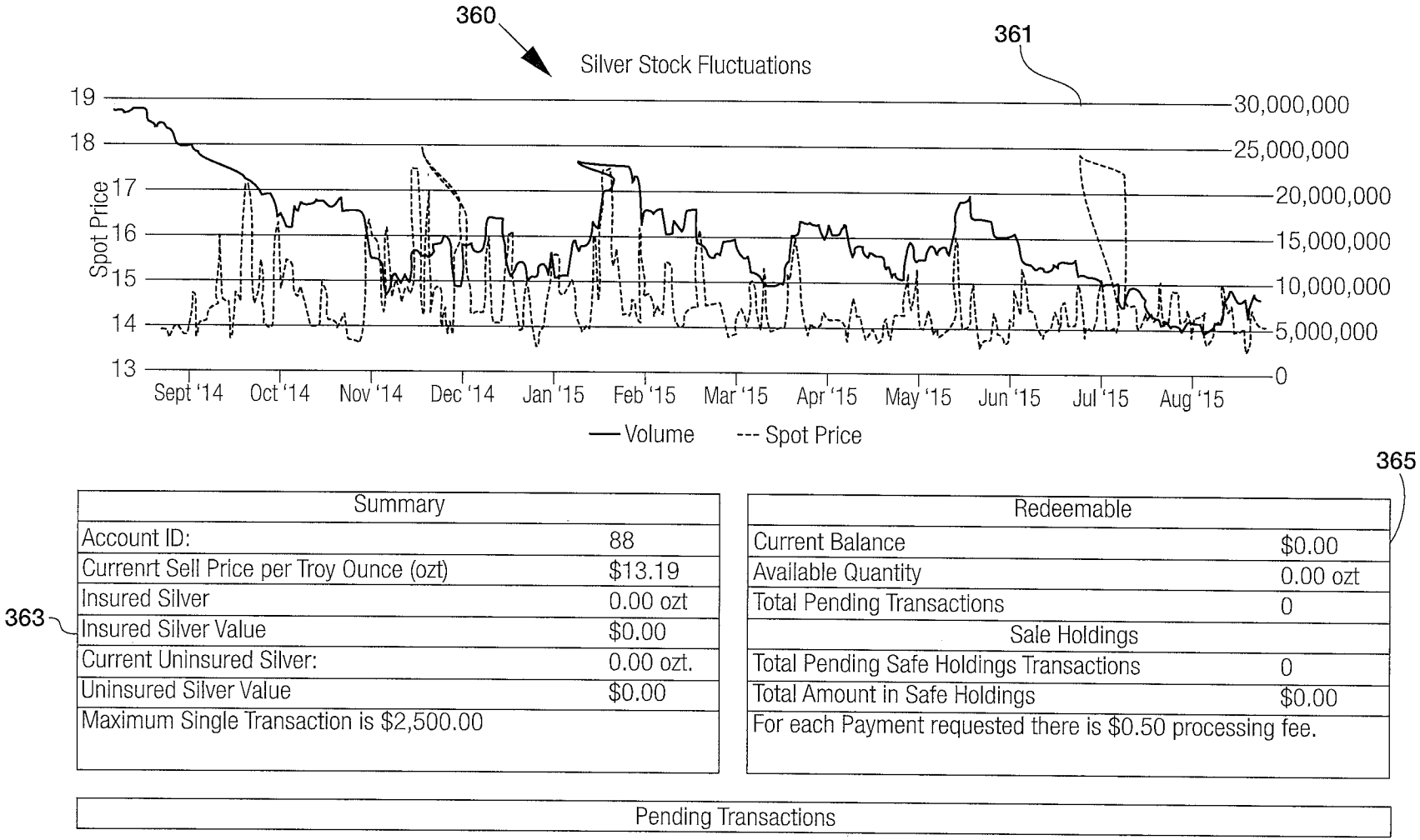
Figure 8D:
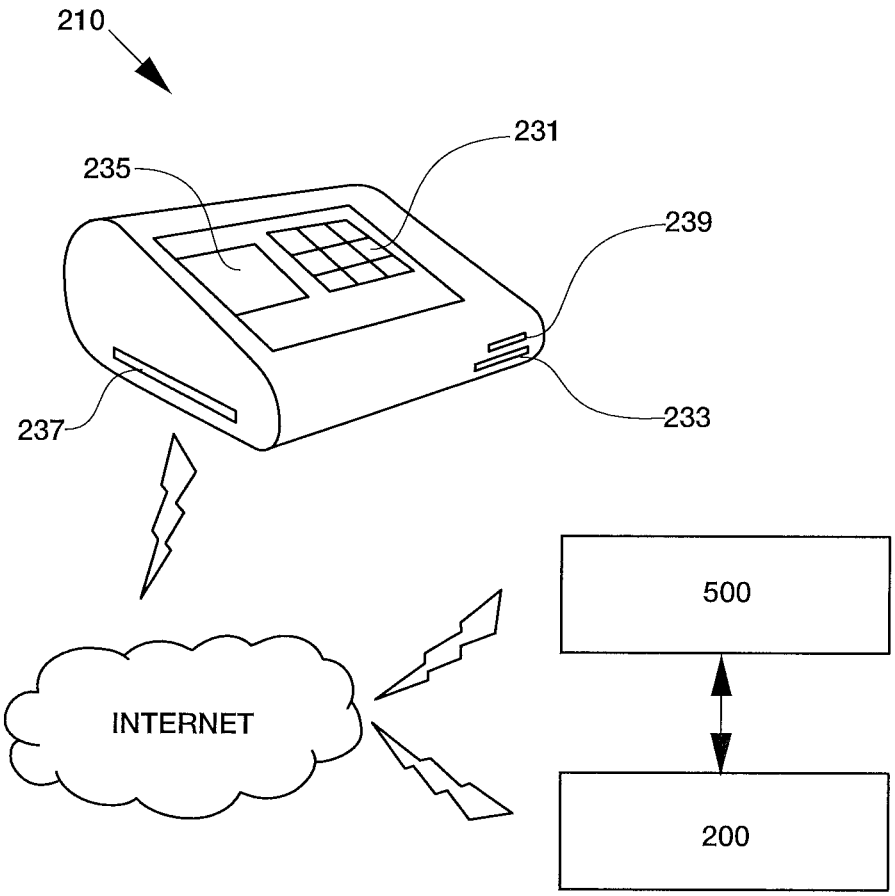

An exchange point of sale device (shown in detail in FIG. 8D), in some examples, may include an input component 231, a receipt generator 233, a display screen 235, a printer 237, a scanner 239, a remote connection to an envelope system and/or a connection to the exchange system 200.

The input component 231 may allow new member input to be entered and existing member redemption information to be entered. The receipt generator 233, may be in communication with a printer 237 associated with the exchange point of sale, by way of text, email, etc. A receipt generated by the receipt generator 233 may include exchange information, such as, a confirmation number and identification information for the new member. The exchange point of sale may be configured to accommodate exchange transactions. The exchange point of sale 210 may display and process, by way of example, a new member entry menu, a store owner menu, a customer search menu, a store owner menu, a customer search menu, and/or an exchange information menu which may include exchange rates, item of value purchase information, and/or amount of item of value redeemable with the member's given redeemable value.

An exchange point of sale 210 may communicate with the exchange center 200 though a router and modem connection with the Internet that may be hardwired and/or wireless. A cellular internet connection may be available for connection to a point of sale 210. An exchange server 214 may be located at the gaming facility and/or remotely from the gaming facility.

Remote access to the exchange center may be offered so that a member can access their member account by way of phone, laptop, personal computer, smart phone, tablet, access point terminal, and/or any type of electronic login, by way of example. Exchange members may be required to manage their exchange purchases and redemptions remotely from the gaming facility.

When referencing the exchange, a silver exchange may be referenced by way of demonstration and example, however, any item of inherent value is considered within the scope of this disclosure and the inventions extend to any item of inherent value in place of silver. By way of example, gas, oil, gemstones, gold, products, foods, items typically considered commodities, etc. may be considered items of value.

Figure 6A:
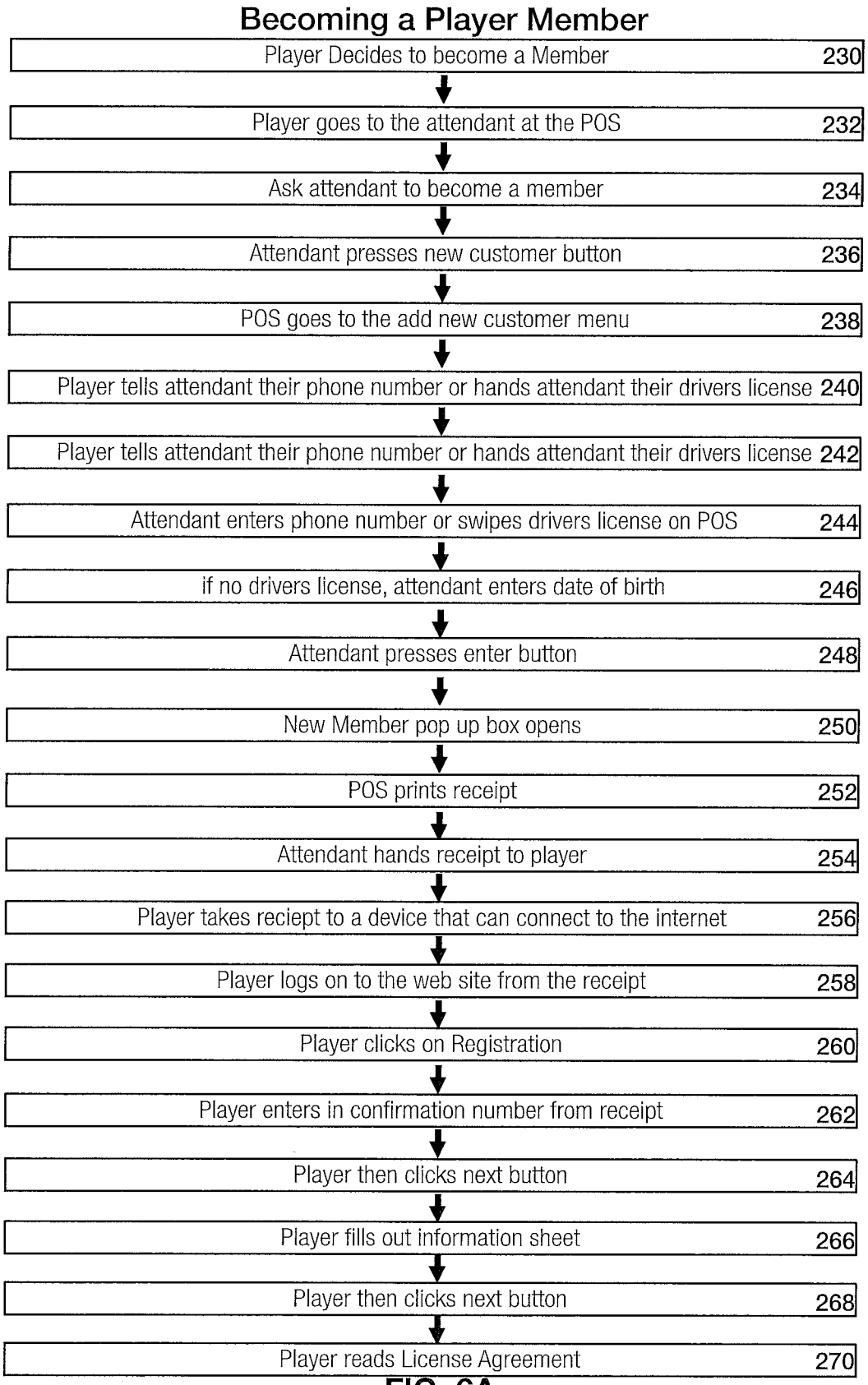
FIGS. 6A and 6B are flow charts showing an exemplary portion of an exchange system transaction.
Figure 6B:
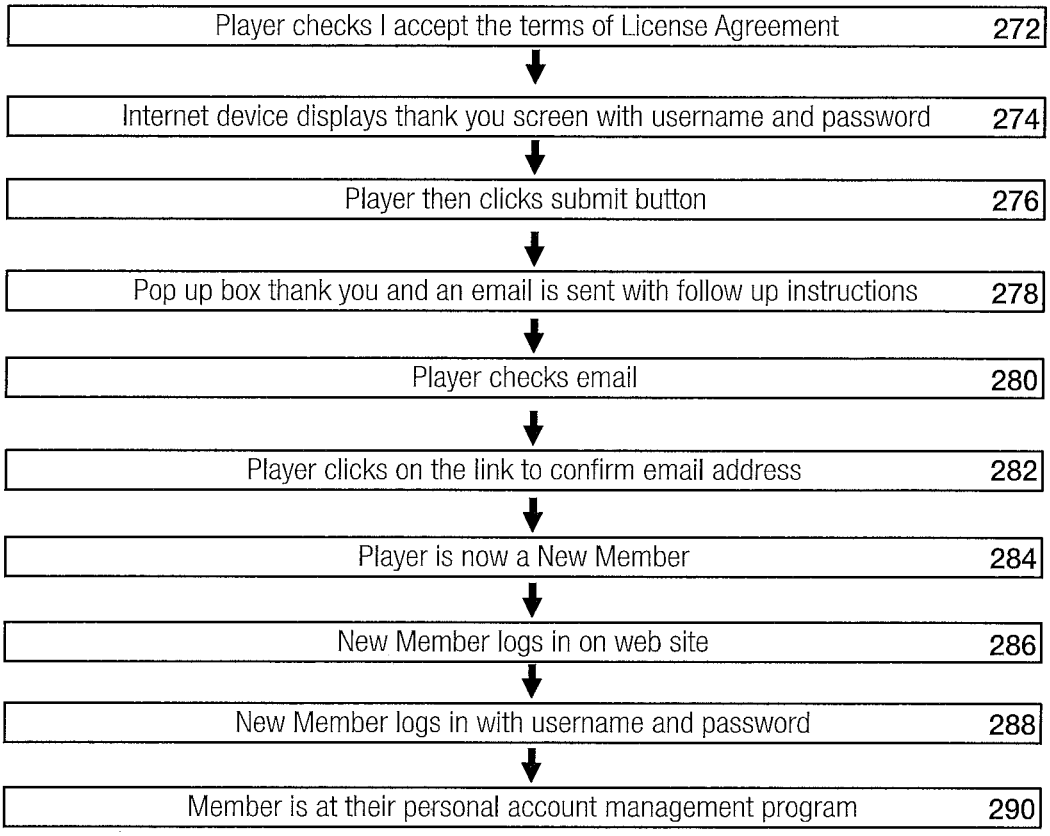

To register with the exchange center 20 (shown in one example in FIGS. 6A-6B), a player may self-register 230 or seek to register 230 with a gaming facility attendant 232 by making the attendant aware the player wants to become a member 234. The player or attendant may access the point of sale terminal and log the player as a new customer 238, in some examples by item selection, scanning, and/or by way of example, button selection 236. The point of sale may include a new customer selection menu 238. Identifying information may be recorded to identify the member, such as driver's license information, birth date 246, contact information and/or biometric identification 240/242 for entry 244/248. A member information may be presented 250 and, in some example, a receipt generated 252/254. The member may then be given an account identifier, by way of example, a receipt with a verification code, an email with a verification code, a password, a text message with a code, etc. 262 The member then may use an internet connected device, for example, a cellular phone, laptop computer, tablet, computer as a management terminal 212 to enter their account identifier and thus their personal account 256/258. The member may be required to agree to the user terms and license agreement 272. A user name and password may be established for the member account. In some examples, the player will confirm information, register and submit agreement to member account information in order to receive a confirmation of new account, for example via email or text 260. Members may be asked to verify membership 262/264 by clicking on a link or responding for membership confirmation in order to open new member account 284. Once a new member account is opened and confirmed, the member may use their personal username and password to access the exchange system in their personal account management program 266-290.

Figure 7A:
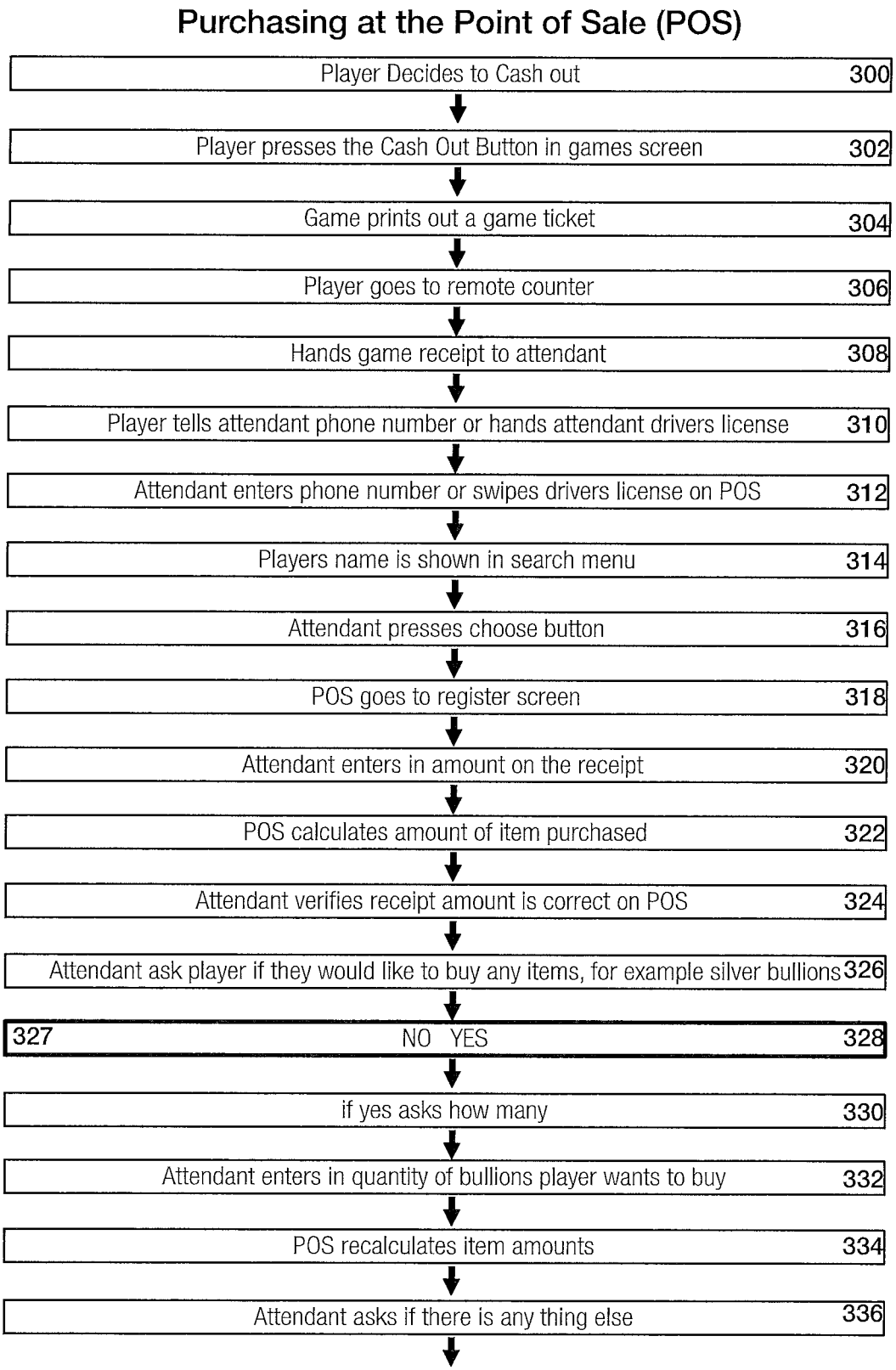
FIGS. 7A and 7B are flow charts showing an exemplary portion of an exchange system transaction.
Figure 7B:
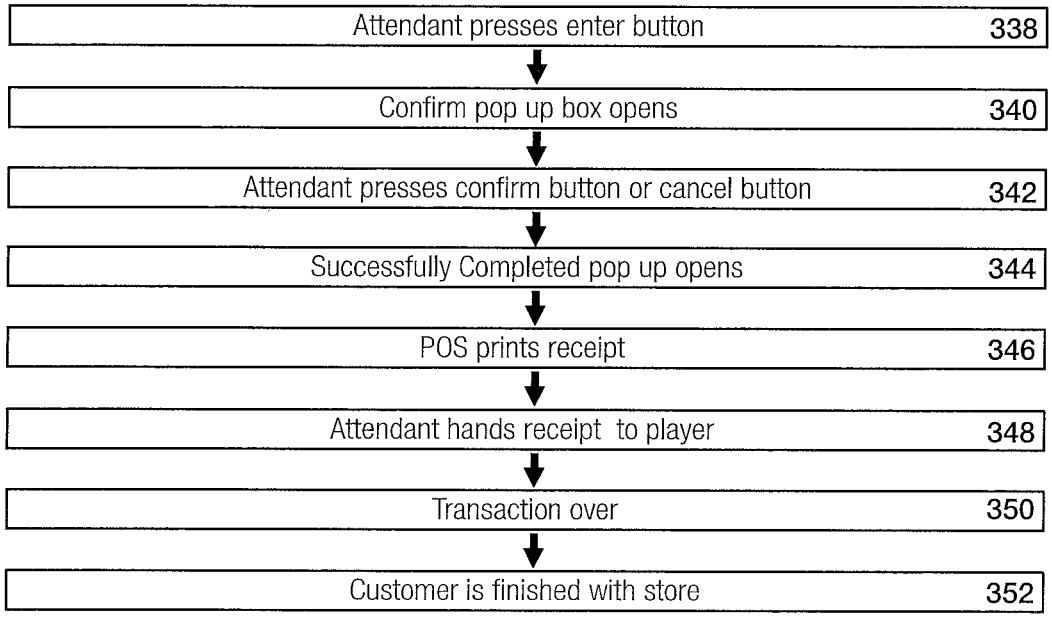

In use, the player may decide to cash out 300 at a gaming machine 12 and selects the option on the gaming machine to cash out a redemption value 302, shown in one example in FIG. 7A-7B. In one example, the gaming machine 12 distributes a representation of the player's redeemable balance value 304, for example, a game ticket with a redeemed value. The player may go to the attendant and presents attendant the representation of the redeemable value 308, a token, for example. The player provides identifying information, for example a driver's license, phone number and/or fingerprint 310/312. The player's member account is accessed through the point of sale terminal 210 and the redemption value amount is logged into the exchange system 200 and associated with the member's account 314-320. The point of sale terminal 210 includes an exchange module 213 that calculates the redeemable value of the item of value sought to be exchanged for the redemption value 322. For example, an amount of silver that may be purchased/exchanged and the redeemable value is calculated. Once the ticket amount is verified as correct in the exchange system 200, the player is offered the item of value, for example silver bullion 326. If the member chooses the bullions exchange/purchase, then an exchange is calculated for the desired exchange. The exchange/purchase is logged into the exchange system 200 and the member is provided a receipt to document the transaction 328-352.

The member may log into their member account remotely via the internet, for example, through their phone or a computer. As shown in FIG. 8A-F, the exchange system often includes an exchange module 27 that produces an exchange information, such as, reports showing, for example, item value fluctuations, the account holder's balance and transactions and value of exchanged items. These reports and/or information generated from these reports may be available to the member in their respective member account. Some of an exchange information may be available to the member and/or facility attendant at an exchange point of sale 210.

Once a member is established, the member can, in some examples, buy directly and/or add a redemption value for any of the items of value/products, such as silver tokens, from any gaming facility having a Point of Sale 210 available to the member.

In some embodiments, the products have a definite magnitude (weight, volume, mass, length, time, area, note, or energy) of a physical quantity (liquid, solid, or gas), that can be sold for any circulatory monetary (US) value such as a coin or note.

On site at a gaming facility, a cashier can scan the member's driver's license to bring up the member account. When exchanging a redemption value and making a product purchase with the gaming facility cashier, the store issued game receipt can be tendered to the cashier, as can currency as a redemption value, to purchase the product of choice. The price of the product is, in some examples, the spot price plus the spread set by exchange 200. The exchange 200 can sell products down to a penny's worth of product. The amount is entered into the exchange 200 and exchange fees and taxes typically are deducted from the amount the member provides, and the product is reserved for the member to manage on the member's personal account at home or anywhere the member chooses and can access the internet. The member is given a receipt and an electronic notification of the purchase that has been completed. The product amount on the POS is reduced by the amount purchased, which is typically monitored at all times. The exchange system 200 may include an accounting module 217 for tracking exchanges, associated refunds, banking transactions, redemptions, and tax implications; a regulatory module 219 for adjusting and setting regulatory compliance limits and rules based upon the jurisdictional requirements; and/or an exchange database 215 for storing exchange transactions and a member accounts information.

At the member's convenience the member can manage their products on their member account. The exchange member account may be configured to calculate and display to the member item of value fluctuation values 360/361. The amount owned of a purchased item of value may be shown in detail or in summary 363. The redeemed amount of the item of value that is ready to be shipped or sold may be calculated by the exchange center and shown to the member 365. Pending exchange transactions may be calculated and shown to the member 370/371. Items of value accumulated but not redeemed by way of acquisition/shipping may be calculated and shown in a safe holding 373. One option may be to have purchased products shipped to the member or to redeem the product for the purchase price minus any fees. The redeemed and resold value amount is sent to the member, for example by Net-Check, by either check or direct deposit to the member's bank account. A member's redeemable amount value used to purchase an item of value may be shown on a receipt as a credit in the member's account, the amount of the item purchased, any fees and taxes and a member account total for the transaction 380. Such a receipt may be generated at the exchange point of sale 210 and printed and/or sent electronically to the member. An entire transaction history may be available on the member's account 390. It a redeemable amount from a gaming device 12 is used to purchase an item of value and the member chooses to resell the item of value on the exchange system 200, the exchange may purchase back the item of value at an exchange amount. The member may then choose to have their positive member balance sent to them, for example in a direct banking transaction and/or by way of a check request 400/391. The member may also request their purchased item of value be shipped to them 420 with a summary transaction display provided to the member 440.

Transactions may be recorded and stored on the member account for further review at a later date. In one example, Net-Check or equivalent may handle all transfers directly between bank accounts, and there are no intermediary entities, transfers occur directly between the store owners' bank accounts and the exchange's 200 bank account, and/or directly between the exchange's bank 200 account and the member's bank accounts.

In one example, a store owner having an exchange system 200 in their gaming facility may keep a fill of product, for example silver tokens, at the store to fill an exchange/purchase of the product on site. In this example, the Point of Sale may be preset to monitor the fill stock amount kept on site. The fill stock amount may have a required minimum. The Point of Sale 210 may be preprogrammed to disallow further transactions if the stock amount falls below the minimum. The minimum may be based upon dollar amounts and/or fill stock product amounts. In one example, when the amount of product sold reaches a preset level, a notification may be sent to the store owner to re-stock. Funds may be electronically transferred from the gaming facility owner to the exchange system 200 in order to have additional stock, for example silver tokens, supplied to the store.

In other examples, no fill stock is required to be kept on site. Product may be purchased and mailed or made available for pick up to the player from any transaction. Not storing the product on site may decrease security issues and stock issues for the participating store. In this case, the store owner offers the item of value, such as silver tokens, for purchase in the store, however, does not keep the item for purchase on site. The purchase of the item of value represents a reservation against a physical stock owned and maintained offsite by the exchange entity. This scenario does not require the store personnel to physically handle the items of value. The member may then handle delivery options of the item of value. When the member accesses their member account they may, opt for a refund of the item of value purchased and/or, by way of example, arrange for delivery of the item of value.

In some examples, a monetary limit may be established within the exchange system 200 to place limits on the amount of money distributed by the system in any one transaction. For example, about a $2,000 to about a $3,000 max limit may be imposed as a limit by the exchange system as a maximum distribution in any one transaction return of funds to a member. In other examples, about a $2,500 max refund/dollar amount distribution may be imposed for any one exchange system payout. In some examples, the max distribution amount may make it easier to fall within regulatory guidelines and in other examples the max distribution amount may increase quality control measures for the system. A member may opt to return and/or sell their entire item of value and/or portions thereof to the exchange system 200 and the exchange system 200 will process all or portions of a refund or purchase amount of an item of value from a member.

In one embodiment, the exchange's main server 214 is configured to control and store everything from settings to storage for the whole exchange system 200 through communication with the various exchange system modules.

The exchange system 200 may include and/or be in contact with an envelope system 500. The security of the exchange system 200 is maintained through use of the envelope 510 while simultaneously allowing access to the exchange system 200 by its members. In one example, the envelope 510 may be considered a web/cloud application located on the remote exchange server 214, the envelope 510 being configured to be able to access local hardware devices of a member when the envelope 210 is accessed by the member through logging into their member account.

In some embodiments, the functional aspect of the point of sale device 210 is associated with or operated by the exchange server 214 (as a website, web application, or cloud application for example) and is accessible electronically by any member via any electronic device on any browser. In some examples, the envelope system 500 is controlled and configured through a server 241.

One problem Applicant realizes with current cloud technology where using an application deployed on the cloud instead of conventional programming techniques, like for Widows or for Macintosh to allow simultaneous access by various entities via a browser, is lack of local hardware access (such as the member's printer and scanner). In this disclosure, Applicant has developed an envelope system 500 in a web/cloud type application that is primarily located entirely on a remote server but is capable of accessing substantially any local device hardware of the member and provide a level of security to the exchange system 200 and exchange system point of sale 210.

In some examples, the exchange point of sale device 210 connects with an exchange point of sale operation 210' that resides on the server 214, operating as a website, web application, cloud application, etc. The point of sale operation 210' is accessible via most any device, on most any browser. By way of example, the operation 210' can read and respond to an exchange protocol or API. The envelope 510 may be associated with a local machine running in the web application. In some examples, the envelope 210 is configured to manage local hardware resources, for example, printers, ports, scanners, displays, etc. The envelope may include a protocal/API's to "talk" to the web application. In one example, the envelope acts as its own browser to access and exchange website. This allows access to a member account and the ability for a member/operator at a point of sale 210 to operate local hardware resources but to restrict access to the exchange system 200.

Figure 9:
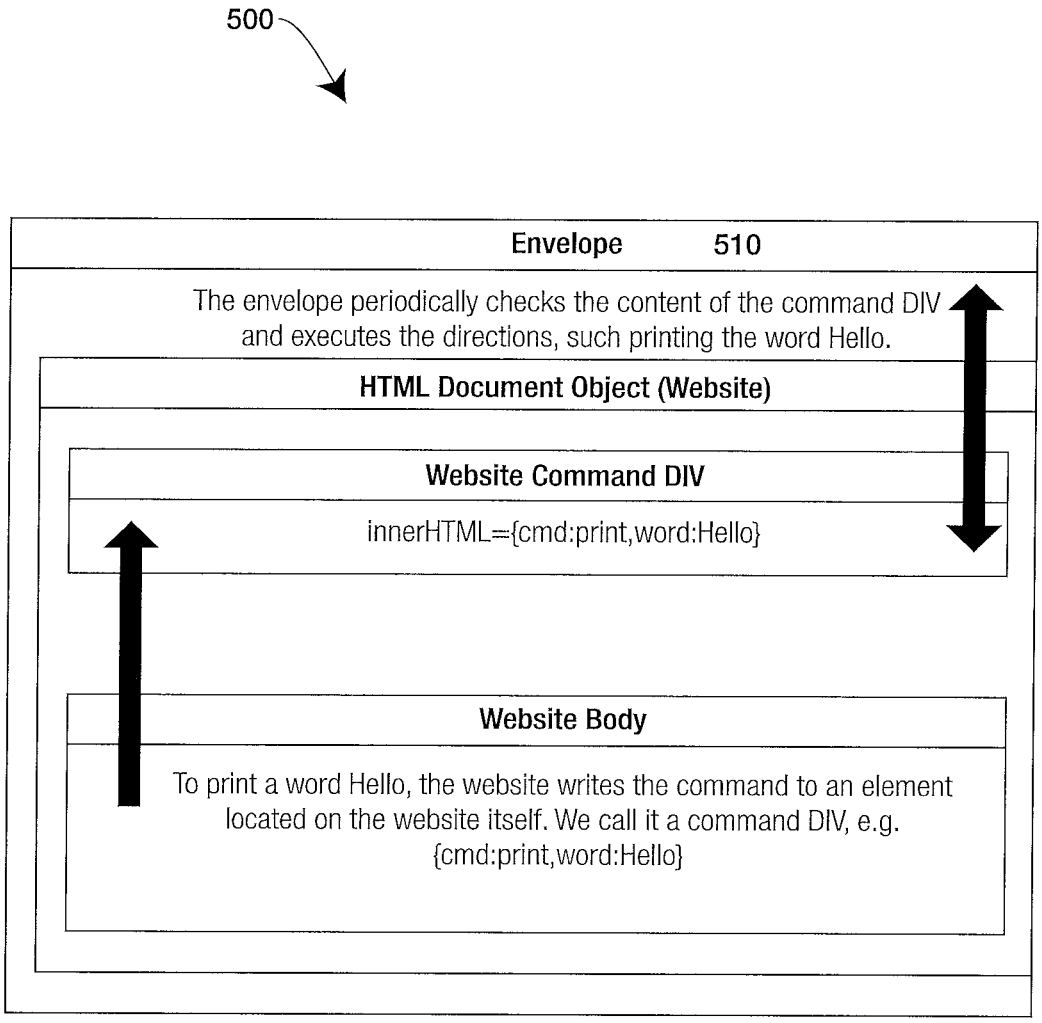
FIG. 9 is a block diagram showing one example of an envelope system as disclosed.

The exchange system 500 may include a local point of sale device 210 for accessing the exchange system from a gaming facility. The local point of sale device 210 may include an envelope application 510, as seen in one example in FIG. 9, which is responsible for local hardware and resource management, such as printers, scanners, ports, display, etc., at the gaming facility or a remote log-in location by the member. The envelope application 510 on a dummy point of sale may use the protocol/API to talk to an exchange site, for example, a secure exchange website. For example, the envelope application 510 may, in one example, be considered a browser that only accesses one or a limited number of websites. The envelope 510 may, in some examples, not include database drivers, passwords, logins, etc. and may operate as a dummy, or one-way application. For example, the point of sale application may occur entirely on the exchange server remotely, not the actual point of sale device, with the point of sale operation being inside the envelope application (for example custom "browser") that manages the local resources. The envelope application 510 may load a particular exchange website and then "listen" for instructions sent to the envelope 510 to be carried out at the point of sale device 210.

In one example, the envelope application 510 resides almost entirely on the exchange server 214 and thus the envelope application 510 essentially, operationally, may be considered a browser not used for the sake of browsing but for allowing websites to access local hardware resources of a particular machine, for example a computer, the point of sale device 210, and/or a member's cellular phone.

In some embodiments, the envelope application 510 may not require login information to a website. For example, there may not be database drivers with stored login credentials to access anything. The envelope application 510, operating as a browser, allows websites to utilize local computer resources and depending on the permissions set, access could be restricted or granted to different resources. Data can flow in both directions and/or, in other embodiments, data can be modified to only flow in one direction. For example, data flow may be allowed only from the exchange server 214 to the site (for example, website) down to the envelope 510 and, thus to the local hardware resources, preventing malicious data mining. The envelope application, by way of example, may execute reverse flow control. Instead of allowing local computers executing remotely running software, the envelope system 500 may allow remotely running software executing whatever is stored on a local client, for example, ports, hardware, devices, software, etc.

In operation, the envelope 510 may connect to the exchange server 214 but while the software itself is running on the server 214. The software running on the server then takes control of the envelope 510. The envelope 510 enables execution of the local client as if the software were installed on the client server itself. The envelope 510 may be in communication with the exchange server 214 to allow a member to execute and record operations at the member's access point, for example, to print a check for a refund amount, to print a check for an exchange item purchase amount, to scan a receipt, etc. through the envelope 510 while maintaining security and control over access to the exchange past the envelope 510 by the member.

Other examples of the envelope system 500 may include unifying multiple CPU's into one global CPU to allow "unification" to happen on any client connected to the internet and running the envelope system 500.

The inventions of this disclosure may also be considered an exchange system 200 including a point of sale operating remotely from a point of sale device 210. The exchange system 200 may be associated with an envelope system 500. The exchange system 200 may be associated with a gaming system 10. The exchange system 200 may include items of variable value over time for which a stable value has been determined by the exchange system 200. The exchange system 200 may be configured to process a transaction for an item of variable value, establishing a purchase price that does not fluctuate with the market over time. The purchase price becomes the frozen value of the item of variable value that was purchased. The exchange system is configured to allow the return exchange of the item of variable value for the frozen value during a set period of time and/or at any time.

In operation, a member of the exchange may purchase a product, such as, an ounce of silver, at a point of sale device 210. During the transaction a frozen value is established by the exchange system 200. The member owns the one once of silver at the frozen value. At any time, the member can either request one ounce of silver to be shipped to the member or can request that an amount of money equal to the frozen value be paid to the member. Once the member requests the ounce of silver be shipped to them, they may then opt to return the ounce of silver to the exchange center 20. The exchange system 200 may be set to accept the silver return for the frozen value and/or the exchange system 200 may be set to accept the silver return for the actual value of the silver as it fluctuates and is valued at the time of return.

The inventions of this disclosure may also be considered a method including any of the systems as disclosed. In one example, disclosed is a method of conducting an electronic game at a gaming facility, and including an exchange option. The game may be a game of chance and/or a game of skill. In one example, a method of conducting a game of chance includes the steps of: providing an electronic gaming machine having a supply of tokens and an electronic memory module; accepting payment from a player; displaying game information to the player; processing game information on the electronic memory module; awarding a player a credit amount for a winning result during a game; allowing the player to cashout a positive balance; offering the cashout to the player in tokens or representations of value, for example silver coins and/or vouchers; and providing a redemption option to the player such that a value of the player's balance may be exchanged through as sale for another faun of currency, for example, a product of value such as silver bullion.

In another example, a method of conducting a game of skill includes the steps of: providing an electronic gaming machine having a supply of tokens and an electronic memory module; accepting payment from a player; displaying game information to the player; accepting input from the player during the game; processing game information on the electronic memory module; awarding a player a credit amount for a winning result during a game; allowing the player to cashout a positive balance; offering the cashout to the player in tokens; and providing a redemption option to the player at the facility such that a value of tokens may be exchanged for another form of currency, such as silver or gold.

The method may also include establishing a communication between an exchange center 20 and a 3rd party exchange entity.

The method may be considered a method of conducting an electronic game, through an electronic gaming system, at a gaming machine where the gaming system offers a payout by way of an exchange through an exchange center by way of any of the apparatus and examples discussed herein.

In other examples, the method includes offering an option to value the player balance in tokens. The exchange module may include programming to value the player balance. A value may alternatively be calculated by an exchange entity and communicated to the exchange module. Still other examples include offering an option for the player to exchange the token balance for an item of value and then selling the item of value for a payment within the gaming system 10.

Still in other embodiments, the method includes offering for sale an item of fluctuating value; establishing a frozen value for the item; allowing a player of a gaming system to purchase the item with credits acquired from a gaming system; and establishing an exchange system accepting returns of the item. The item of fluctuating value may be silver. The silver may be, by way of example, in tokens, bouillon granules, coins, bars, etc. The return value may be the frozen value. The item of value may be any item with fluctuating value, by way of example, gemstones, gold, gasoline, oil, etc.

Numerous characteristics and advantages have been set forth in the foregoing description, together with details of structure and function. Many of the novel features are pointed out in the appended claims. The disclosure, however, is illustrative only, and changes may be made in detail, especially in matters of shape, size, and arrangement of parts, within the principle of the disclosure, to the full extent indicated by the broad general meaning of the terms in which the general claims are expressed. It is further noted that, as used in this application, the singular forms "a," "an," and "the" include plural referents unless expressly and unequivocally limited to one referent.

Certain modifications and improvements will occur to those skilled in the art upon a reading of the foregoing description. It should be understood that all such modifications and improvements have been deleted herein for the sake of conciseness and readability but are properly within the scope of the following claims.

I claim:

1. A method of conducting a game at a gaming device with remote redemption options comprising the steps of:

providing an electronic gaming machine having a supply of tokens and an electronic memory module;

accepting payment from a player;

displaying game information to the player;

processing game information on the electronic memory module;

awarding a player a credit amount for a winning result during a game;

allowing the player to cashout a positive balance in a non-cash redemption value;

offering to exchange the non-cash redemption value for another item of value;

determining an appropriate exchange value for a purchase of the item of value in place of the non-cash redemption value, providing an exchange center where the item of value may be exchanged for currency, wherein the exchange center is in communication with an exchange system, the exchange system including:

an exchange server for controlling the exchange system and an exchange system parameters, the exchange server being in communication with:

an exchange database for housing an exchange membership and an exchange information;

an exchange accounting module for calculating an exchange interactions made by players within the exchange system and communicating with banking institutions external to the exchange module; and a regulatory module for presetting rules associated with regulatory control systems; an exchange management terminal for accessing and configuring the exchange system, and a member access module for allowing exchange system members to remotely access and control a member account information.

2. The method of claim 1 wherein the game is a game of chance.

3. The method of claim 1 wherein the game is a game of skill.

4. The method of claim 1 including locating apart from the gaming machine a point of sale exchange device in communication with the exchange center.

5. The method of claim 4 including providing an access point to the exchange center to players through the point of sale exchange device.

6. The method of claim 1 including offering an option for the player to exchange the redeemable balance for the item of value within a gaming system of the gaming device.

7. A method of offering remote redemption options for a redeemable value generated at a gaming system device, comprising:

providing a gaming machine with remote redemption options, on which a player may play a game and receive a redeemable value, the gaming machine including a payment acceptance device, at least one display screen, at least one game module adapted for storing gaming information, operating a game and determining a payout to a player, a control electronics in communication with the at least one game module, and a payout dispenser;

establishing a redeemable value from the play of the game by the player, cashing out the redeemable value in a non-cash tender from the game to the player, offering apart from the gaming machine a point of sale exchange device, accepting the redeemable value into the point of sale exchange device, establishing a connection between the point of sale exchange device and an exchange center, wherein the exchange center is in communication with an exchange system, controlling the exchange system and the exchange system parameters with an exchange server, establishing a communication between the exchange server and an exchange database for housing an exchange membership and exchange information, an exchange accounting module for calculating exchange interactions made by players within the exchange and communicating with banking institutions external to the exchange, setting a regulatory module for presetting rules associated with regulatory control systems;

including an exchange management terminal for accessing and configuring the exchange, and a member access module for allowing exchange members to remotely access and control a member account information;

offering a player an item of value in exchange for the player's redeemable value, conducting an exchange transaction purchasing an item of value with the player's redeemable value, establishing a value amount for the item of value in a member's exchange account, offering the player the option to receive the item of value or sell the item of value in the exchange center for an exchange rate, and offering a player an option to redeem a positive balance in the member's exchange account.

8. The method of claim 7 including establishing a connection between the exchange center and an envelope system.

* * * * *